US012270108B2

(12) United States Patent
Sohn et al.

(10) Patent No.: US 12,270,108 B2
(45) Date of Patent: Apr. 8, 2025

(54) PLATED STEEL SHEET HAVING EXCELLENT CORROSION RESISTANCE, WORKABILITY AND SURFACE QUALITY AND METHOD FOR MANUFACTURING SAME

(71) Applicant: POSCO, Gyeongsangbuk-do (KR)

(72) Inventors: Il-Ryoung Sohn, Gwangyang-si (KR); Sung-Joo Kim, Pohang-si (KR); Tae-Chul Kim, Gwangyang-si (KR); Bong-Hwan Yoo, Gwangyang-si (KR); Myung-Soo Kim, Pohang-si (KR); Jong-Sang Kim, Gwangyang-si (KR); Sang-Tae Han, Pohang-si (KR); Kwang-Won Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 0 days.

(21) Appl. No.: 18/010,868

(22) PCT Filed: Jun. 18, 2021

(86) PCT No.: PCT/KR2021/007705
§ 371 (c)(1),
(2) Date: Dec. 16, 2022

(87) PCT Pub. No.: WO2021/256906
PCT Pub. Date: Dec. 23, 2021

(65) Prior Publication Data

US 2023/0235438 A1 Jul. 27, 2023

(30) Foreign Application Priority Data

Jun. 19, 2020 (KR) ..... 10-2020-0075335

(51) Int. Cl.
*C23C 2/06* (2006.01)
*C21D 8/02* (2006.01)
(Continued)

(52) U.S. Cl.
CPC ..... *C23C 2/06* (2013.01); *C21D 8/0205* (2013.01); *C21D 8/0226* (2013.01); *C22C 18/00* (2013.01);
(Continued)

(58) Field of Classification Search
CPC ..... C23C 2/06; C23C 2/40; C22C 18/04
(Continued)

(56) References Cited

U.S. PATENT DOCUMENTS

2018/0237900 A1 8/2018 Kobayashi et al.
2019/0368007 A1 12/2019 Tokuda et al.
(Continued)

FOREIGN PATENT DOCUMENTS

EP 4036270 A1 8/2022
JP 2006-009100 A 1/2006
(Continued)

OTHER PUBLICATIONS

Terada et al. JP 2011/214145 A Google Patents Machine Translation, printed May 2, 2024, Oct. 27, 2011, entire translation (Year: 2011).*
(Continued)

*Primary Examiner* — Katherine A Christy
(74) *Attorney, Agent, or Firm* — Morgan, Lewis & Bockius LLP

(57) ABSTRACT

The present invention relates to a plated steel sheet having excellent corrosion resistance, workability and surface quality, and at the same time, capable of reducing occurrence of liquid metal embrittlement (LME).

20 Claims, 5 Drawing Sheets

(51) Int. Cl.

| | |
|---|---|
| ***C22C 18/00*** | (2006.01) |
| ***C22C 18/04*** | (2006.01) |
| ***C23C 2/00*** | (2006.01) |
| ***C23C 2/02*** | (2006.01) |
| ***C23C 2/40*** | (2006.01) |

(52) U.S. Cl.
CPC ..... *C22C 18/04* (2013.01); *C23C 2/0035* (2022.08); *C23C 2/02* (2013.01); *C23C 2/40* (2013.01)

(58) Field of Classification Search
USPC ..... 428/659
See application file for complete search history.

(56) References Cited

U.S. PATENT DOCUMENTS

| | | | |
|---|---|---|---|
| 2021/0002751 | A1 | 1/2021 | Sohn et al. |
| 2022/0010420 | A1 | 1/2022 | Han et al. |

FOREIGN PATENT DOCUMENTS

| | | | |
|---|---|---|---|
| JP | 2011-214145 | A | 10/2011 |
| JP | 6687175 | B1 | 4/2020 |
| KR | 10-2013-0133358 | A | 12/2013 |
| KR | 10-2014-0074231 | A | 6/2014 |
| KR | 10-2015-0066339 | A | 6/2015 |
| KR | 10-2015-0070841 | A | 6/2015 |
| KR | 10-2019-0078434 | A | 7/2019 |
| KR | 10-2019-0102239 | A | 9/2019 |
| KR | 10-2058889 | B1 | 12/2019 |
| KR | 10-2020-0063983 | A | 6/2020 |
| WO | 2007/108496 | A1 | 9/2007 |
| WO | 2011/001662 | A1 | 1/2011 |
| WO | 2018/139620 | A1 | 8/2018 |
| WO | 2020/111775 | A1 | 6/2020 |

OTHER PUBLICATIONS

Extended European Search Report dated Feb. 13, 2023 issued in European Patent Application No. 21826805.0.
International Search Report dated Sep. 28, 2021 issued in International Patent Application No. PCT/ KR2021/007705 (with English translation).
Office Action issued in corresponding Japanese Application No. 2022-570075 dated Feb. 20, 2024.

* cited by examiner

[FIG. 1]
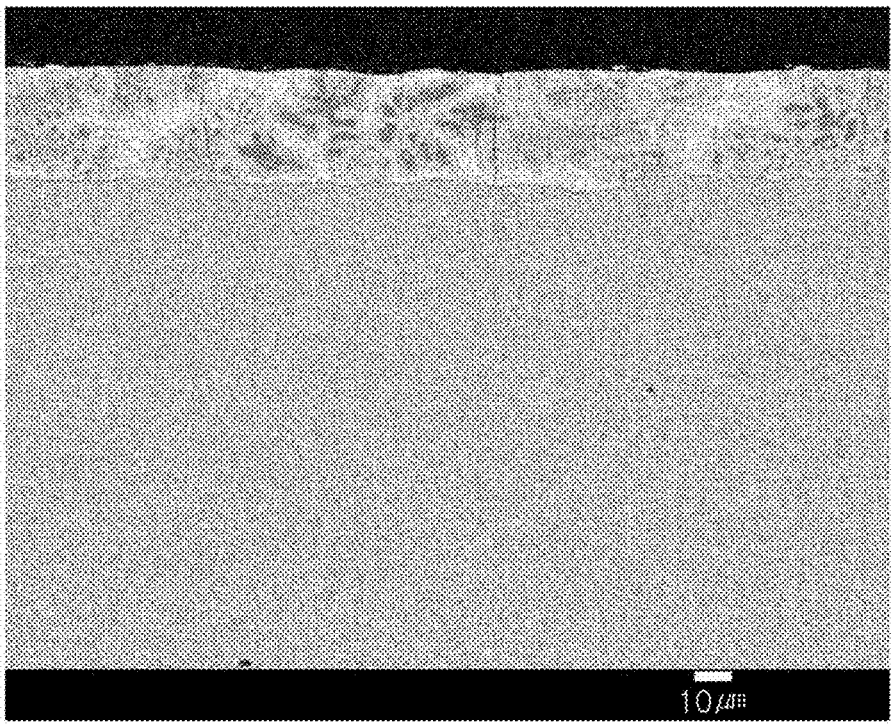
[FIG. 2]
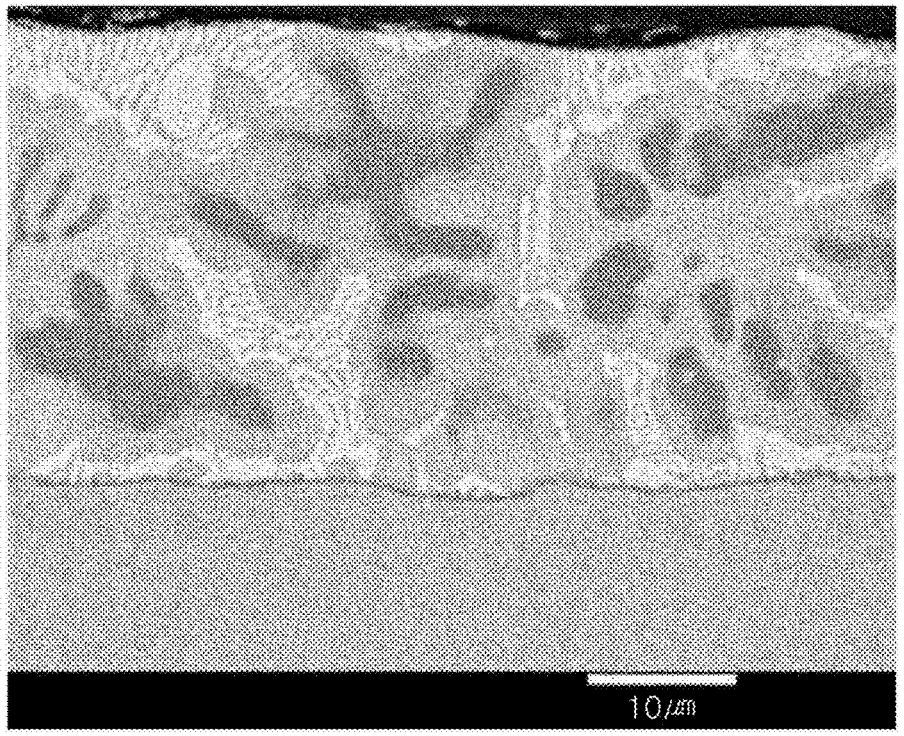

[FIG. 3]
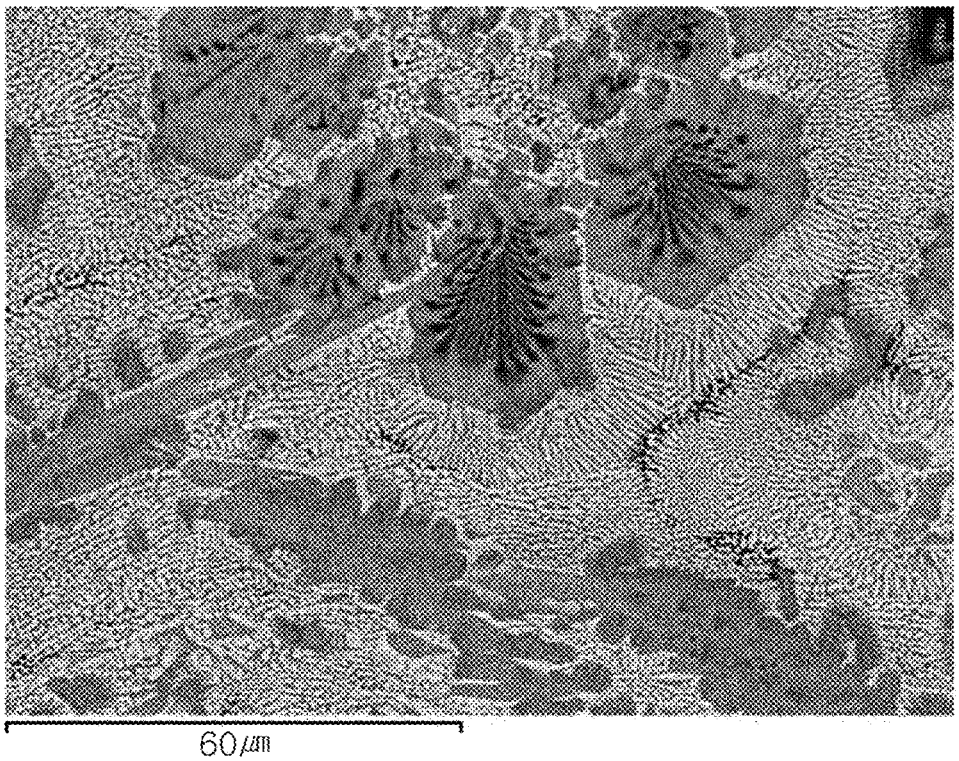
[FIG. 4]
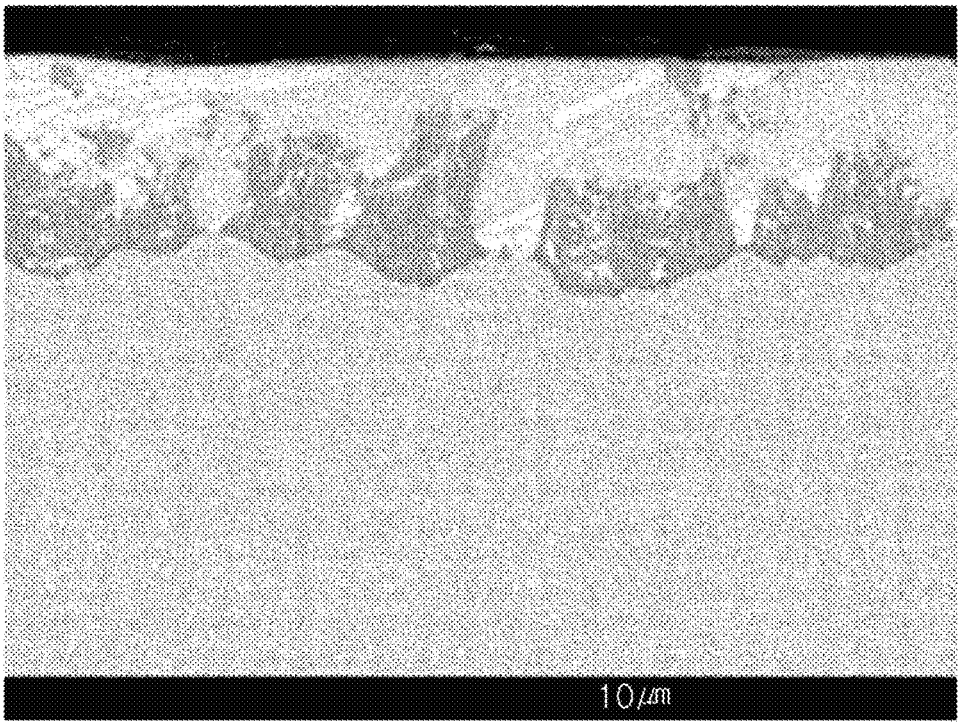

[FIG. 5]
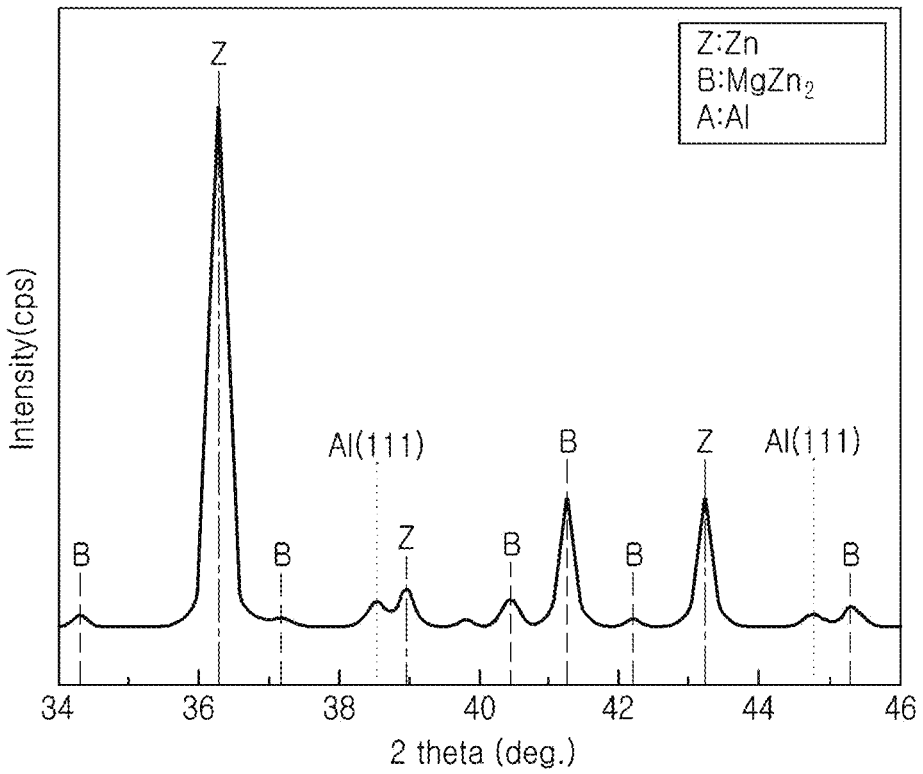
[FIG. 6]
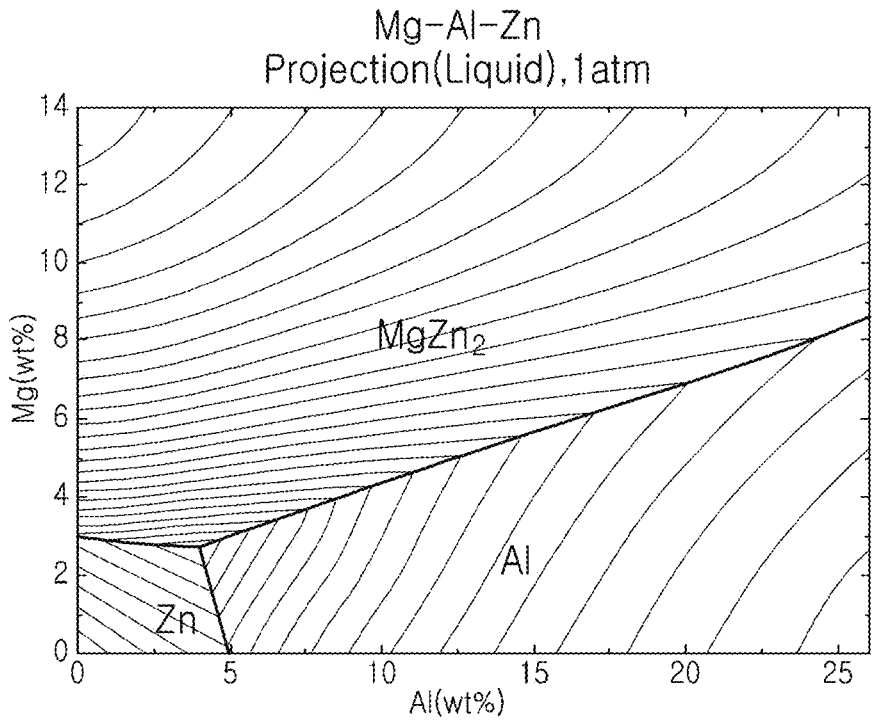

[FIG. 7]
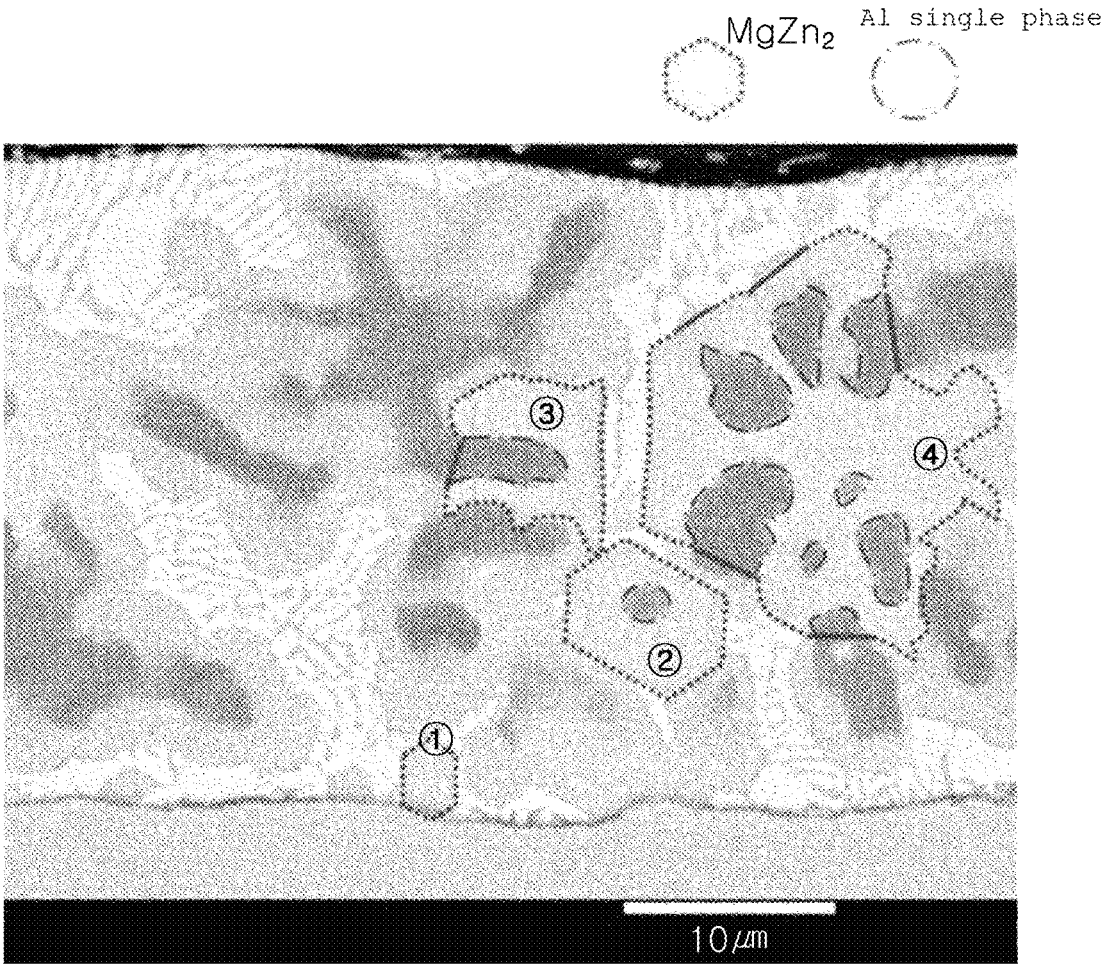
[FIG. 8]
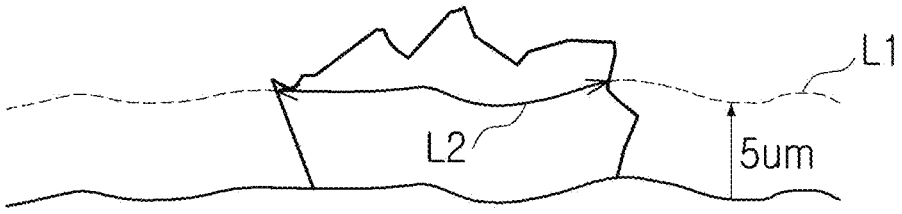

[FIG. 9]
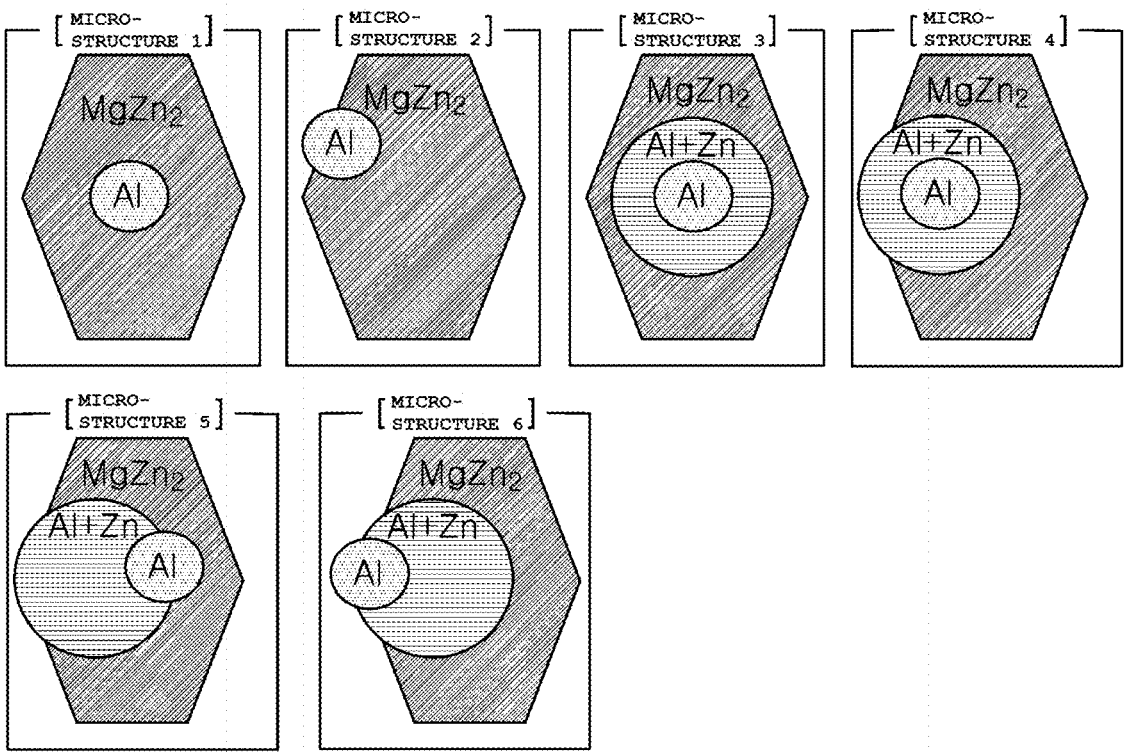

PLATED STEEL SHEET HAVING EXCELLENT CORROSION RESISTANCE, WORKABILITY AND SURFACE QUALITY AND METHOD FOR MANUFACTURING SAME

CROSS-REFERENCE OF RELATED APPLICATIONS

This application is the U.S. National Phase under 35 U.S.C. § 371 of International Patent Application No. PCT/KR2021/007705, filed on Jun. 18, 2021, which in turn claims the benefit of Korean Application No. 10-2020-0075335, filed on Jun. 19, 2020, the entire disclosures of which applications are incorporated by reference herein.

TECHNICAL FIELD

The present invention relates to a plated steel sheet having excellent corrosion resistance, workability, and surface quality and a method for manufacturing same.

BACKGROUND ART

A zinc-based plated steel sheet has a sacrificial characteristic in which, when it is exposed to a corrosive environment, zinc having a lower oxidation-reduction potential than iron corrodes first to suppress corrosion of a steel plate. In addition, as zinc in a plating layer is oxidized, a dense corrosion product is formed on a surface of a steel plate to block the steel plate from an oxidation atmosphere, thereby improving corrosion resistance of the steel plate. Due to the advantageous properties as such, the scope of application of the zinc-based plated steel sheet has been recently expanded to steel sheets for construction materials, home appliances, and automobiles.

However, due to an increase in air pollution caused by industrial advancement, a corrosive environment gradually deteriorates, and due to strict regulations of resource and energy conservation, there is a growing need for development of a steel plate having better corrosion resistance than a conventional zinc-based plated steel sheet.

In order to improve the problem, various studies for a manufacturing technology of a zinc alloy-based plated steel sheet, by adding elements such as aluminum (Al) and magnesium (Mg) to a zinc plating bath to improve the corrosion resistance of a steel plate have been conducted. As a representative example, there is a Zn—Mg—Al-based zinc alloy plated steel sheet to which Mg is further added to a Zn—Mg—Al-based composition system.

Meanwhile, a zinc-based plated steel sheet is commonly used in a processed state in many cases, and in the case of a Zn—Mg—Al-based zinc alloy plated steel sheet, a large amount of an intermetallic compound having a high hardness is included in the plating layer to deteriorate bending workability, such as causing cracks in the plating layer at the time of bending processing. Even after being processed, there is also a problem that zinc in a molten state during welding by spot welding, or the like, penetrates along grain boundaries of base iron and causes a so-called liquid metal embrittlement (LME) to cause brittle cracks.

In addition, although the zinc-based plated steel sheet after being processed is often provided outside a product, surface quality is inferior due to surface damage, and the like, by processing, and thus, it is necessary to improve outer sheet quality.

Therefore, a technology to meet advanced demands for excellent corrosion resistance, processability, liquid metal embrittlement (LME) occurrence reduction, surface quality, and the like, as described above has not been developed.

(Patent Document 1 Korean Publication No. 2013-0133358

SUMMARY OF INVENTION

Technical Problem

An aspect of the present disclosure is to provide a plated steel sheet having excellent corrosion resistance, workability, and surface quality, and at the same time, capable of reducing occurrence of liquid metal embrittlement (LME) and a method for manufacturing the same.

The subject of the present invention is not limited to the above. The subject of the present invention will be understood from the overall content of the present specification, and those of ordinary skill in the art to which the present invention pertains will have no difficulty in understanding the additional subject of the present invention.

Solution to Problem

According to an aspect of the present disclosure, a plated steel sheet is provided, the plated steel sheet including:

a base steel sheet;

a Zn—Mg—Al based steel sheet plating layer provided on at least one surface of the base steel sheet; and an Fe—Al based inhibition layer provided between the base steel sheet and the Zn—Mg—Al based plating layer, wherein the plating layer includes, by weight: 4% or more of Mg; 2.1 times or more of Mg content and 14.2% or less of Al; 0.2% or less (including 0%) of Si; 0.1% or less (including 0%) of Sn, with a balance of Zn and unavoidable impurities.

According to another aspect of the present disclosure, a method for manufacturing a plated steel sheet is provided, the method including:

an operation of dipping a base steel sheet, the base steel sheet, including by weight %: 4% or more of Mg; 2.1 times or more of a Mg content and 14.2% or less of Al; 0.2% or less (including 0%) of Si; 0.1% or less (including 0%) of Sn, with a balance of Zn and unavoidable impurities, in a plating bath maintained at a temperature 20 to 80° C. higher than a solidification start temperature in an equilibrium phase diagram and hot-dip galvanizing the same; and an operation of cooling the steel sheet starting from a bath surface of the plating bath to a top roll section at an average cooling rate of 3 to 30° C./s using inert gas.

wherein the cooling operation controls a cooling rate to satisfy the following Relations 1-1 and 1-2, $$A > 2.5/\{\ln(t \times 20)\}^{1/2} \times B \quad \text{[Relation 1-1]}$$

$$0.7 \times C \leq B \leq 1.2 \times C \quad \text{[Relation 1-2]}$$

where, in Relations 1-1 and 1-2, t is a thickness of the steel sheet, A is an average cooling rate (° C./s) from a plating bath temperature to a solidification start temperature, B is an average cooling rate (° C./s) from the solidification start temperature to a solidification initiation temperature −30° C., and C is an average cooling rate (° C./s) from a solidification start temperature −30° C. to 300° C.

Advantageous Effects of Invention

As set forth above, according to an embodiment of the present disclosure, a plated steel sheet having excellent corrosion resistance, workability and surface quality, and at the same time, capable of reducing occurrence of liquid metal embrittlement (LME) and a method for manufacturing the same may be provided.

Various and beneficial merits and effects of the present disclosure are not limited to the descriptions above, and may be more easily understood in a process of describing specific exemplary embodiments in the present disclosure.

BRIEF DESCRIPTION OF DRAWINGS

FIG. 1 is a 500× magnified photograph of a cross-sectional specimen, observed by a field emission scanning electron microscope (hereinafter, referred to as "FE-SEM"), the cross-sectional specimen being made in a thickness direction for a plated steel sheet of Example 1 so that an entire plating layer and base iron are observed together.

FIG. 2 is a 2,000× magnified photograph of a cross-section of a plated steel sheet in a thickness direction of Example 4 of the present disclosure, observed by a field emission scanning electron microscope (FE-SEM).

FIG. 3 is a 1,000× magnified photograph of a surface of a plated steel sheet of Example 2 of the present disclosure, observed by a field emission scanning electron microscope (FE-SEM).

FIG. 4 is a 1,000× magnified photograph of a cross-sectional specimen of a plated steel sheet in a thickness direction of Example 10 of the present disclosure in which outburst occurs, observed by a field emission scanning electron microscope (FE-SEM).

FIG. 5 is an X-ray diffraction (hereinafter, referred to as 'XRD') graph of a plating layer of Example 16 of the present disclosure.

FIG. 6 illustrates an Mg—Al—Zn ternary phase diagram.

FIG. 7 illustrates a 2,500× magnified photograph of a cross-section of a plated steel sheet of Example 4 of the present disclosure, observed by a field emission scanning electron microscope (FE-SEM).

FIG. 8 is a diagram schematically illustrating a method for measuring a length occupied by an outburst phase.

FIG. 9 illustrates a schematic diagram of a microstructure that can be observed in the plated steel sheet of the present disclosure.

BEST MODE FOR INVENTION

Terms used in the present specification are for explaining specific exemplary embodiments rather than limiting the present disclosure. In addition, a singular form used in the present specification includes a plural form also, unless the relevant definition has a clearly opposite meaning thereto.

The meaning of "comprising" used in the specification is to embody the configuration and is not to exclude the presence or addition of other configurations.

Unless otherwise defined, all terms including technical terms and scientific terms used in the present specification have the same meaning as would be commonly understood by a person with ordinary skill in the art to which the present disclosure pertains. Pre-defined terms are interpreted as being consistent with the relevant technical literature and the disclosure herein.

Hereinafter, the plated steel sheet according to an aspect of the present disclosure will be described in detail. A content of each element in the present disclosure is by wt %, unless otherwise particularly defined.

In a conventional Zn—Mg—Al-based zinc alloy plated steel sheet-related technology, Mg was added to improve corrosion resistance. However, when Mg is added excessively, occurrence of floating dross in a plating bath increases, and the dross should be removed often. Therefore, an upper limit of an Mg addition amount was limited to 3%.

In addition thereto, as described above, it was not possible to provide a plated steel sheet capable of reducing occurrence of liquid metal embrittlement (LME) while having excellent corrosion resistance, workability and surface quality at the same time, in the prior art.

Accordingly, as a result of studying examples to solve the above-described problems, the present inventors have invented a plated steel sheet that can further improve corrosion resistance, workability, and surface quality, compared to the prior art, and at the same time, reduce liquid metal embrittlement, and a method for manufacturing the same, thereby resulting in completion of the present disclosure. Hereinafter, the configuration of the present disclosure will be described in detail.

According to an aspect of the present disclosure, a plated steel sheet includes a base steel sheet; a Zn—Mg—Al-based plating layer provided on at least one surface of the base steel sheet; and a Fe—Al-based inhibition layer provided between the base steel sheet and the Zn—Mg—Al-based plating layer.

In the present disclosure, the type of base steel sheet may not be particularly limited. For example, the base steel sheet may be a Fe-based base steel sheet used as the base steel sheet of a usual zinc-based plated steel sheet, that is, a hot-rolled steel sheet or a cold-rolled steel sheet, but is not limited thereto. Otherwise, the base steel sheet may be, for example, a carbon steel, an ultra-low carbon steel, or a high manganese steel, used as, for example, materials for construction, home appliances, and automobiles.

However, as a non-limiting example, the base steel sheet may have a composition including, by weight: 0.17% or less (0 exclusive) of C, 1.5% or less (0 exclusive) of Si, 0.01 to 2.7% of Mn, 0.07% or less (0 exclusive) of P, 0.015% or less (0 exclusive) of S, 0.5% or less (0 exclusive) of Al, 0.06% or less (0 exclusive) of Nb, 1.1% or less (0 inclusive) of Cr, 0.06% or less (0 exclusive) of Ti, and 0.03% or less (0 exclusive) of B, with a balance of Fe and other unavoidable impurities.

According to an aspect of the present disclosure, a Zn—Mg—Al-based plating layer formed of a Zn—Mg—Al-based alloy may be provided on at least one surface of the base steel sheet. The plating layer may be formed on only one surface of the base steel sheet or may be formed on both surfaces of the base steel sheet. Here, the Zn—Mg—Al-based plating layer refers to a plating layer including Mg and Al and 50% or more of Zn.

In addition, according to an aspect of the present disclosure, a Fe—Al-based inhibition layer may be provided between the base steel sheet and the Zn—Mg—Al-based plating layer. The Fe—Al-based inhibition layer is a layer including an intermetallic compound of Fe and Al, and the intermetallic compound may include FeAl, $FeAl_3$, $Fe_2Al_5$, and the like. Besides, some components, for example, 40% or less of components derived from the plating layer, such as Zn and Mg, may be further included. The inhibition layer is a layer formed by alloying of Fe diffused from the base steel sheet at the beginning of plating and plating bath components. The inhibition layer serves to improve close adhesion between the base steel sheet and the plating layer, and also to block Fe diffusion from the base steel sheet to the plating layer.

According to an aspect of the present disclosure, the plating layer may include, by weight: 4% or more of Mg; 2.1 times or more and 14.2% or less of a Mg content; 0.2% or less (including 0%) of Si; 0.1% or less (including 0%) of Sn; and a balance of Zn and unavoidable impurities. Hereinafter, each component will be described in detail.

Mg: 4% or More

Mg is an element serving to improve corrosion resistance of a plated steel plate, and in the present disclosure, a content of Mg in the plating layer is controlled to be 4% or more, for securing a desired level of excellent corrosion resistance, and more preferably, the content of Mg may be controlled to be 4.1% or more. Meanwhile, since the effect is improved as Mg is added from a viewpoint of securing corrosion resistance, an upper limit of the Mg content may not be particularly limited. However, as an example, when Mg is excessively added, dross may occur, so the Mg content may be controlled to 6.7% or less, more preferably 6.5% or less.

Al: 2.1 Times or More and 14.2% or Less of Mg Content

In general, when Mg is added at 1% or more, an effect of improving corrosion resistance is exhibited, but when Mg is added at 2% or more, a plating bath floating dross occurrence by oxidation of Mg in the plating bath increases, so that there is a problem in that the dross is often removed. Due to the problem, in the conventional technology, in Zn—Mg—Al-based zinc alloy plating, Mg was added at 1.0% or more to secure corrosion resistance, while the upper limit of the Mg content was set to 3.0% and commercialized.

However, as described above, in order to further improve corrosion resistance, it is necessary to increase the Mg content to 4% or more. However, when Mg is included in the plating layer at 4% or more, there is a problem in that dross occurs by oxidation of Mg in the plating bath. In order to suppress dross occurrence as such, it is necessary to include 2.1 times or more of an Al content in the plating layer as the Mg content. In order to further improve the above-described effect of dross inhibition, a lower limit of the Al content in the plating layer may be preferably 8.7%, more preferably 8.8%. However, when Al is excessively added for dross inhibition, a melting point of the plating bath is raised and an operating temperature is accordingly too high, thereby causing a problem by high temperature operation, such as erosion of a plating bath structure and deformation of a steel plate. Besides, when an Al content in the plating bath is too high, Al reacts with Fe in the base iron and does not contribute to the formation of a Fe—Al inhibition layer, and rapidly increase a reaction contributing to the formation of an outburst phase, thereby excessively forming an outburst phase in a lump shape to deteriorate corrosion resistance. Therefore, an upper limit of the Al content in the plating layer may be controlled to preferably 14.2%, more preferably 14%, and most preferably 13.8%.

In addition, according to an aspect of the present disclosure, the Al and Mg contents may be determined to be positioned in the vicinity of a two processes line of $MgZn_2$ and Al in an Mg—Al—Zn ternary phase diagram. Here, being determined to be positioned in the two processes line includes not only the case of being determined to be positioned precisely in the two processes line, but also the case of being determined to be positioned within Mg=±0.5 wt % and Al=±1 wt %, based on the two processes line, slightly out of the two processes line.

FIG. 6 illustrates a Mg—Al—Zn ternary phase diagram when the X-axis is an Al content and the Y-axis is a Mg content. In FIG. 6, A represents the conditions corresponding to an example of the present disclosure, and as shown in FIG. 5, the Al and Mg contents may be determined to be positioned in the vicinity of the two processes line of $MgZn_2$ and Al in the Mg—Al—Zn ternary phase diagram.

Si: 0.2% or Less (Including 0%)

Regarding a galvanized steel sheet, Si may be usually added to prevent alloying. However, when Si is excessively added, Si reacts with Mg in the plating bath to form $Mg_2Si$. Since $Mg_2Si$ formed in this manner has a brittle structure, it may act as a factor that deteriorates workability during processing such as bending processing. Therefore, in the present disclosure, in order to secure processability, a Si content may be controlled to 0.2% or less, preferably 0.02% or less, more preferably 0.01% or less, and most preferably 0.009% or less. Alternatively, since it is preferable that $Mg_2Si$ is not formed, Si may be 0%.

Sn: 0.1% or Less (Including 0%)

Sn may be added to improve the corrosion resistance of the plating layer. However, in the present disclosure, when Sn is excessively added to the Zn—Mg—Al-based plating bath, a melting point is lowered and a solidification completion point of the plating layer is lowered by 10° C. or more, and the lowering of the solidification point may cause surface defects due to non-uniform solidification. In addition, during spot welding, it is easy to cause liquid metal embrittlement (LME) cracks generated by penetration of the molten plating layer into an interface of base iron. In addition, Sn reacts with Mg in the plating bath to form an $Mg_2Sn$ intermetallic compound, which is relatively light and has a high melting point of 770° C., compared to other phases in the plating layer. Therefore, when the $Mg_2Sn$ intermetallic compound is generated, it floats to a surface of the plating bath and is difficult to be re-dissolved, and when the $Mg_2Sn$ intermetallic compound remaining on the surface of the plating bath is adsorbed to the surface of the plating layer during hot-dip plating, it may cause surface defects.

Therefore, in the present disclosure, a Sn content in the plating layer needs to be controlled to 0.1% or less. On the other hand, in order to express the desired effect, the Sn content may be more preferably 0.09% or less, and most preferably 0.05% or less.

Balance of Zn and Other Unavoidable Impurities

A balance other than the composition of the plating layer described above may be Zn and other unavoidable impurities. The unavoidable impurities may include any impurities as long as they may be incorporated unintentionally in the manufacturing process of a common hot-dip galvanized steel sheet, and a person skilled in the art may easily understand the meaning.

According to an aspect of the present disclosure, although not particularly limited, the plating layer may optionally further satisfy a configuration described later.

Fe: 1% or Less

According to an aspect of the present disclosure, an Fe component included in a base steel sheet may be diffused during the plating process and included in the plating layer, and although not particularly limited, an Fe content in the plating layer may be 1% or less (including 0%). Meanwhile, more preferably, an upper limit of the Fe content in the plating layer may be 0.3%, and a lower limit of the Fe content in the plating layer may be 0%.

Meanwhile, when Fe in the base steel sheet is diffused to the plating layer, it is alloyed or produces an intermetallic compound, thereby forming an outburst phase so that the inhibition layer is discontinuously formed. However, since the outburst phase is a factor which reduces corrosion resistance, it is preferred in the present disclosure that the inhibition layer is continuously formed, based on a cut surface of the plated steel sheet (in a direction, perpendicular to a rolling direction of the steel sheet). That is, the inhibition layer being continuously formed means that the outburst phase is not formed.

However, a certain amount of Fe may be diffused from the base steel sheet to the plating layer to form an outburst phase, which is an alloy phase between the base steel sheet and the plating layer.

Therefore, though the outburst phase is formed in the present disclosure, in terms of securing corrosion resistance, when an interface line of the base steel sheet is spaced 5 μm apart toward the surface of the plating layer, in the cut surface in the thickness direction of the steel sheet, it is necessary for a length occupied by the outburst phase intersecting the spaced line to be 10% or less, more preferably be controlled to be 5% or less, and most preferably be controlled to be 0%, to the length of the spaced line. Since a lower limit of a ratio of the length occupied by the outburst phase intersecting the spaced line includes 0%, it is not particularly limited thereto. Here, a line drawn along the interface formed by the layer in contact with the base steel sheet is referred to as an interface line. The interface line of the base steel sheet may be more preferably controlled to 5% or less, and most preferably be 0%.

A method of measuring the length occupied by the outburst phase is schematically shown in FIG. 8. As shown in FIG. 8, L1 represents a length of the spaced line, and L2 represents a length occupied by the outburst phase intersecting the spaced line.

Therefore, the measurement method of FIG. 8 described above may be applied as it is to measure the length occupied by the outburst phase, with FIG. 4 which is a 1000× magnified photograph of a cross-section specimen in the thickness direction of the plated steel sheet of Example 10 described below of the present disclosure, taken by FE-SEM, as an example.

As a result, it is preferred in the present disclosure that the inhibition layer is continuously formed, and even in the case in which the inhibition layer is discontinuously formed, it is preferred that the inhibition layer is formed so that it occupies 90% or more of the total interface length of the base steel sheet and the inhibition layer. For example, an interface length and a length ratio therefrom may be measured at a magnification of the scanning electron microscope of 1,000 times, and include the case of being observed in at least one of three random points measured.

According to an aspect of the present disclosure, the content of Fe in the outburst phase is 10 to 45% by weight, the alloy phase of the outburst phase includes at least one of $Fe_2Al_5$, FeAl, and Fe—Zn-based phases, and Zn may be included at 20% by weight or more.

According to an aspect of the present disclosure, the inhibition layer may have a thickness of 0.02 μm or more and 2.5 μm or less. The inhibition layer serves to prevent alloying to secure corrosion resistance, but since it is brittle, it has an adverse effect on workability, and thus, the thickness may be controlled to 2.5 μm or less. However, in order to act as the inhibition layer, it is preferred that the thickness is controlled to 0.02 μm or more. In terms of further improving the above-described effect, preferably, an upper limit of the thickness of the inhibition layer may be 1.8 μm (more preferably 0.9 μm). In addition, a lower limit of the thickness of the inhibition layer may be 0.05 μm. Here, the thickness of the inhibition layer may refer to a minimum thickness in a direction perpendicular to the interface of the base steel sheet.

According to an aspect of the present disclosure, as the case of discontinuously forming the inhibition layer, the inhibition layer and the outburst phase may coexist in the interface of the base steel sheet. That is, the outburst phase includes a region intersecting the line moving 5 μm in parallel from the interface, as described above, and may be to a part where the region is in contact with the interface of the base steel sheet. However, the alloy layer including the Fe—Al-based intermetallic compound other than the outburst phase is regarded as being an inhibition layer.

Meanwhile, according to an aspect of the present disclosure, based on the cut surface of the plated steel sheet, the number of $Mg_2Si$ phases having a major axis of 500 nm or more in contact with the interface between the inhibition layer and the plating layer may be 10 or less (including 0%) per 100 μm of the interface length. In this case, a cross-sectional hardness of the plating layer may be 200 to 450 Hv. Here, $Mg_2Si$ in contact with the interface between the plating layer and the inhibition layer includes both $Mg_2Si$ passing through the interface or in contact with the interface. In addition, the interface length represents a length measured along the interface between the plating layer and the inhibition layer. Stress is concentrated at the interface between the inhibition layer and the plating layer, and when a large number of $Mg_2Si$, which is a brittle metallic compound, is formed at the interface, it serves as a starting point for crack occurrence during bending. In particular, since the Zn—Mg—Al-based plating layer according to an aspect of the present disclosure has a high hardness of 200 to 450 Hv and is brittle, the presence of the $Mg_2Si$ phase may further deteriorate workability. In terms of preventing the above-described factors of deterioration in workability and further improving workability, the number (Na) of $Mg_2Si$ phases having a major axis of 500 nm or more in contact with the interface between the inhibition layer and the plating layer per 100 μm of the interface length may be 4 or less. More preferably, the number thereof may be 2 or less.

Therefore, in the present disclosure, while the hardness of the plating layer is controlled to be high in a range of 200 to 450 Hv by controlling the content of Mg to be high, the number of $Mg_2Si$ phases having a major axis of 500 nm or more in contact with the interface between the inhibition layer and the plating layer is controlled to be 10 or less per 100 μm of interface length, so that it is possible to provide a plated steel sheet having excellent workability as well as improving corrosion resistance. For example, the interface length and the number of $Mg_2Si$ phases may be measured using a scanning electron microscope at a magnification of 1000, and a plurality of photographs may be repeatedly taken until the interface length of 100 μm is observed.

In addition, according to an aspect of the present disclosure, in order to secure corrosion resistance, the sum of areas of an Al single phase included in a $MgZn_2$ phase may exist in an area ratio of 0.5 to 10% to a total cross-sectional area of the plating layer, more preferably it may exist in an area ratio of 0.5 to 5%. The ratio of the Al single phase included in the $MgZn_2$ phase to the total cross-sectional area of the plating layer satisfies the above-mentioned range, so that the Al single phase included in the $MgZn_2$ phase may play a role in maintaining a skeleton, thereby securing excellent corrosion resistance and at the same time, excellent sacrificial corrosion resistance.

Here, the Al single phase included in the $MgZn_2$ phase means not only an Al single phase completely included inside the $MgZn_2$ phase, but also a phase including a portion of the Al single phase in the $MgZn_2$ phase.

Specifically, two points of contact where a boundary line of an Al phase (or other phases surrounding the Al phase) and a boundary line of an $MgZn_2$ phase meet are connected in a straight line, thereby calculating the region occupied by the Al single phase inside the $MgZn_2$ phase.

That is, the $MgZn_2$ and the Al single phase may be distinguished from a 2,500× magnified photograph of a cross-section of the plated steel sheet, as shown in FIG. 7, observed by a field emission scanning electron microscope (FE-SEM). Here, a region of ① shows that only $MgZn_2$ is present, a region of ② shows that the Al single phase is included in $MgZn_2$, a region of ③ shows that a portion of the Al single phase is included inside the $MgZn_2$ phase and the other portion protrudes out of the $MgZn_2$ phase, and a region of ④ shows a case in which Al is included in the $MgZn_2$ phase, and a portion of the Al single phase is included inside the $MgZn_2$ phase and the other portion the Al single phase protrudes out of the $MgZn_2$ phase.

Alternatively, these experimental results may be utilized by component mapping so that Mg and Al component distributions may be viewed using EPMA (Electron Probe Micro Analyzer), which is generally known in the art. Thereby, a total fraction of the $MgZn_2$ phase in the plating structure may be obtained, and a fraction of only Al belonging to the inside of $MgZn_2$ or extending over $MgZn_2$ may be separately obtained.

That is, according to an aspect of the present disclosure, the Al single phase may be entirely or partially positioned inside the $MgZn_2$ phase.

In addition, according to an aspect of the present disclosure, a ratio of diffraction intensity I(200)/I(111), which is a ratio of X-ray diffraction (XRD) intensity I(200) of plane (200) of the Al single phase 200 and a ratio of X-ray diffraction (XRD) intensity I(111) of plane (111) of the Al single phase may be 0.8 or less (0 exclusive), more preferably 0.79 or less, and most preferably 0.7 or less. In this case, a ratio of integrated intensity of the (200) plane to integrated intensity of the (111) plane of Al was measured. By satisfying this, corrosion resistance may be exhibited by controlling the ratio of the Al single phase in the $MgZn_2$ phase. According to the present disclosure, a certain amount of Al should be included in the $MgZn_2$ phase in order to exhibit corrosion resistance, and this structure characteristic may be confirmed by an orientation ratio of Al crystals when measured by XRD. For XRD measurement, the X-ray diffraction pattern may be confirmed by measuring the intensity ratio of each orientation of Al within a range of 34 to 46° (2 theta) using the Cu-Kα source.

According to an aspect of the present disclosure, the Al single phase included inside the $MgZn_2$ phase may correspond to one of the following cases, which is schematically shown in FIG. 9:

an Al single phase included inside a $MgZn_2$ phase, and completely included by the $MgZn_2$ phase [Microstructure 1 in FIG. 9], an Al single phase, a portion of the Al single phase being included inside the $MgZn_2$ phase, and the other portion of the Al single phase protruding out of the $MgZn_2$ phase [Microstructure 2 in FIG. 9], an Al single phase, in which a mixed phase of Al and Zn is completely included inside the $MgZn_2$ phase, and completely included in the mixed phase of Al and Zn [Microstructure 3 in FIG. 9]

an Al single phase completely included in the mixed phase of Al and Zn, wherein a portion of the Al single phase is included inside the $MgZn_2$ phase and the other portion of the Al single phase protrudes out of the $MgZn_2$ phase[Microstructure 4 in FIG. 9], an Al single phase partially included in the mixed phase of Al and Zn, wherein a portion of the Al single phase is included inside the $MgZn_2$ phase and the other portion of the Al single phase protrudes out of the $MgZn_2$ phase, and completely included inside a $MgZn_2$ region [Microstructure 5 in FIG. 9], and an Al single phase, partially included in the mixed phase of Al and Zn, wherein a portion of the Al single phase is included inside the $MgZn_2$ phase and the other portion of the Al single phase protrudes out of the $MgZn_2$ phase, and a portion of the Al single phase is included inside the $MgZn_2$ region and the other of the Al single phase protrudes out of the $MgZn_2$ region [Microstructure 6 in FIG. 9].

Meanwhile, the Al single phase in the present disclosure means a single phase mainly composed of Al and Zn and other components may be dissolved and included in the phase. According to an aspect of the present disclosure, the Al single phase may include, by weight, 40 to 70% of Al, with a balance of Zn and unavoidable impurities.

According to an aspect of the present disclosure, a ratio of the Al single phase in the plating layer to the entire cross-section of the plating layer may be 1 to 15% by area fraction. When the ratio of the Al single phase is 1% or more, the plating layer may contribute to a role as a physical protective barrier by Al functioning to retain a skeleton. On the other hand, when the ratio of the Al single phase is 15% or less, it is possible to prevent deterioration of stability due to corrosion of Al. In terms of improvement of the above-described effect, preferably, a lower limit of the ratio of the Al single phase may be 1.7%. Alternatively, in terms of improvement of the above-described effect, an upper limit of the ratio of the Al single phase may be 11% (more preferably 9.8%).

In addition, according to an embodiment of the present disclosure, the Al—Zn mixed phase included in the $MgZn_2$ phase may be present in an amount of 10% or less to the total cross-sectional area of the plating layer.

According to According to an aspect of the present disclosure, an arithmetic average surface roughness (Ra) of the plating layer may be 0.5 to 3.0 μm, more preferably, Ra may be 0.6 to 3.0 μm. When the surface roughness Ra is less than 0.5 μm, a surface frictional force is reduced and plate materials slip when the plate materials are stacked on top of each other, which may interfere with work. In addition, when rust preventive oil is applied to a surface of the steel sheet, a characteristic of the rust preventive oil remaining on the surface thereof may be deteriorated. On the other hand, when the surface roughness Ra exceeds 3.0 μm, cracks may occur in the plating layer due to excessive pressure in the process of forming the surface roughness to exceed 3.0 μm by physical pressure.

According to an aspect of the present disclosure, a ten-point average surface roughness Rz of the plating layer may be 1 to 20 μm, more preferably 5 to 18 μm. When Rz is less than 1 μm or exceeds 20 μm, Rz may be observed to be too bright or dark in terms of metallic luster, representing an aesthetic effect of the surface of the steel sheet. Therefore, it is appropriate to be managed in a range of 1 to 20 μm as an appropriate range. The above-described roughness was measured according to KS B 0161, and a cutoff value was based on 2.5 μm when measuring the roughness.

According to an aspect of the present disclosure, a cross-sectional hardness of the plating layer may be 200 to 450 Hv. The hardness of the plating layer is related to the type and size of a crystal phase constituting the plating layer, and when the cross-sectional hardness is less than 200 Hv, the resistance of the plating layer to external frictional force is weakened. As a result, when there is surface friction from the outside, a friction coefficient may increase, resulting in poor workability and also deformation. However, if the hardness of the plating layer exceeds 450 Hv, it may be excessively brittle, so that there may be a side effect of cracks occurring in the plating layer during processing.

According to an aspect of the present disclosure, the plating layer may have a thickness of 5 to 100 μm, more preferably 5 to 90 μm. When the thickness of the plating layer is less than 5 μm, the plating layer may locally become too thin due to errors due to variations in the thickness of the plating layer, and thus corrosion resistance may be deteriorated. When the thickness of the plating layer exceeds 100 μm, cooling of the hot-dip plating layer may be delayed, for example, solidification defects such as flow patterns may occur on the surface of the plating layer, and productivity of the steel sheet may decrease in order to solidify the plating layer.

Additionally, although not particularly limited, according to an aspect of the present disclosure, in the plating layer, LDH may be formed on the surface of the plating layer before Simoncolite and Hydrozincsite under an atmospheric environment and a chloride environment (e.g., ISO14993 test standard). That is, rapid nucleation-crystallization of LDH (Layered Double Hydroxide; $(Zn,Mg)_6Al_2(OH)_{16}(CO_3)\cdot 4H_2O$), which is a dense initial corrosion product, is formed on the surface of the plating layer when maintained under a corrosive environment (or under an atmospheric environment for a long time) may be performed. Thereafter, over time, it is uniformly distributed over the surface to shield a corrosion active region, and it is possible to induce uniform formation of secondarily formed Simonkolleite; $Zn_5(OH)_8Cl_2$ and Hydrozincite; $(Zn_5(OH)_6(CO_3)_2$.

According to an aspect of the present disclosure, a LDH corrosion product, formed in a surface layer portion of the plating layer may be formed within 6 hours under an atmospheric environment and within 5 minutes under an ISO14993 chloride environment.

Next, a method for manufacturing a plated steel sheet according to another aspect of the present disclosure will be described in detail. However, this does not mean that the plated steel sheet of the present disclosure should be necessarily manufactured by the following manufacturing method.

According to an aspect of the present disclosure, an operation of preparing a base steel sheet may be further included, and the type of the base steel sheet is not particularly limited. The base steel sheet may be a Fe-based base steel sheet, used as the base steel sheet of a usual hot-dip galvanized steel sheet, that is, a hot-rolled steel sheet or a cold-rolled steel sheet, but the present disclosure is not limited thereto. In addition, the base steel sheet may be, for example, carbon steel, ultra-low carbon steel, or high manganese steel used as a material for construction, home appliances, and automobiles, but the present disclosure is not limited thereto.

According to an aspect of the present disclosure, an operation of dipping a base steel sheet including, by weight: 4% or more of Mg; 2.1 times or more of a Mg content and 14.2% or less of Al; 0.2% or less (including 0%) of Si; 0.1% or less (including 0%) of Sn, with a balance of Zn and unavoidable impurities, in a plating bath and hot-dip galvanizing the same. In order to manufacture a plating bath having a composition described above, a composite ingot containing predetermined Zn, Al and Mg or a Zn—Mg and Zn—Al ingot containing individual components may be used. Meanwhile, the components of the plating bath may be as described for the components of the plating layer described above except for the content of Fe introduced from the base steel sheet.

In order to supplement the plating bath consumed by hot-dip plating, the ingot is additionally dissolved and supplied. In this case, a method of directly dipping the ingot and dissolving the same in the plating bath may be selected, or a method of dissolving the ingot in a separate pot and then supplanting the molten metal in the plating bath may be selected.

In addition, according to an aspect of the present disclosure, a temperature of the plating bath may be maintained at a temperature of 20 to 80° C. higher than a solidification start temperature (Ts) in an equilibrium phase diagram, and in this case, although not particularly limited, the solidification start temperature (Ts) in the equilibrium phase diagram may be in a range of 390 to 460° C. (more preferably 390 to 452° C.). Alternatively, the temperature of the plating bath may be maintained in a range of 440 to 520° C. (more preferably, 450 to 500° C.).

As the temperature of the plating bath increases, it is possible to secure fluidity in the plating bath and form a uniform composition, and to reduce a floating dross occurrence amount. When the temperature of the plating bath is lower than 20° C. (or lower than 440° C.), compared to the solidification start temperature in the equilibrium phase diagram, the dissolution of the ingot is very slow and the viscosity of the plating bath is high, so that it may be difficult to secure excellent surface quality of the plating layer. On the other hand, when the temperature of the plating bath is higher than 80° C. (or higher than 520° C.), compared to the solidification start temperature in the equilibrium phase diagram, ashy defects by Zn evaporation may be caused on the plating surface, and diffusion of Fe may be excessively progressed to excessively form an outburst phase. In addition, diffusion of Fe may be excessively progressed to excessively form an outburst phase due to the too high plating bath temperature. Accordingly, a length occupied by the outburst phase intersecting the above-described spaced line may exceed 10% of the length of the spaced line, which may cause a decrease in corrosion resistance.

According to an aspect of the present disclosure, a bathing time after dipping the base steel sheet in the plating bath may be in a range of 1 to 10 seconds.

In addition, according to an aspect of the present disclosure, an operation of cooling the steel sheet from a bath surface of the plating bath to a top roll section at an average cooling rate of 3 to 30° C./s using inert gas may be included. Here, when the cooling rate from the bath surface of the plating bath to the top roll section is less than 3° C./s, a $MgZn_2$ structure is developed too coarsely to bend the surface of the plating layer severely. In addition, a binary process structure and a ternary process structure are formed coarsely, respectively, so that it may be unfavorable to secure uniform corrosion resistance and workability. On the other hand, when the cooling rate from the bath surface of the plating bath to the top roll section exceeds 30° C./s, a liquid phase is started to solidify into a solid phase during a melting plating process and rapidly solidified in a temperature section in which the liquid phase is all changed into a solid phase, and thus, the size of the $MgZn_2$ structure is formed too small, resulting in locally non-uniform corrosion resistance. In addition, due to lack of uniform growth of the Fe—Zn—Al phase, workability may be deteriorated, with a focus on the interface of the plating layer and the base steel sheet, and an amount of nitrogen used is increased for an excessive cooling rate to increase manufacturing costs. In terms of further improving the above-mentioned effect, the average cooling rate may be more preferably 3 to 27° C./s.

According to an aspect of the present disclosure, the inert gas may include one or more of $N_2$, Ar, and He, and in terms of reducing manufacturing costs, it is preferred to use $N_2$ or $N_2$+Ar.

In addition, according to an aspect of the present disclosure, in the cooling operation, the cooling rate may be controlled to satisfy the following relations 1-1 and 1-2.

$$A>2.5/\{\ln(t\times 20)\}^{1/2}\times B \quad \text{[Relation 1-1]}$$

$$1200.7\times C\leq B\leq 1.2\times C \quad \text{[Relation 1-2]}$$

where, in the relations 1-1 and 1-2, t is a thickness of the steel sheet, A is an average cooling rate (° C./s) from a plating bath temperature to a solidification start temperature, B is an average cooling rate (° C./s) from the solidification start temperature to the solidification start temperature −30° C., and C is an average cooling rate (° C./s) from the solidification start temperature −30° C. to 300° C. In this case, according to an aspect of the present disclosure, A is not particularly limited, but may be in a range of 4 to 40° C./s.

As a case where relations 1-1 and 1-2 are not satisfied, when an initial cooling rate is too fast, the size of a $MgZn_2$ phase is formed too small, so that a form containing an Al single phase inside the $MgZn_2$ phase may not be formed, and the Al single phase inside the $MgZn_2$ phase may not be controlled within an appropriate range. Meanwhile, when the initial cooling rate is too slow, since an Al component contributes to formation of a Zn—Al mixed phase, the Al single phase may not be formed, and it may be difficult to control a range of the Al single phase in the plating layer to an appropriate range.

Meanwhile, in order to reduce surface defects of the plating layer, it is important to secure uniformity of a solidification structure of the plating layer. As such, in order to secure the uniformity, solidification nuclei should be generated uniformly in an initial stage of solidification, and it is important to control a melting temperature and cooling rate for each plating component. In addition, by controlling the cooling rate in this manner, it is possible to suppress the formation of $Mg_2Si$ phase, or the like, which is disadvantageous in workability, at the interface between the inhibition layer and the plating layer.

To this end, in the present disclosure, as described above, in the cooling operation, a cooling rate in each section is controlled to satisfy the relations 1-1 and 1-2 by setting a 3-step cooling section, so that the solidification nuclei in the initial stage of solidification may be uniformly formed so that surface defects in a final product may be reduced.

In particular, as the steel sheet begins to be withdrawn from the plating bath, a starting point of solidification is determined in the initial cooling section. In this case, when the starting point of solidification is determined too slowly because the cooling rate does not satisfy the above-described relations, a structure is locally formed coarsely so that non-uniform solidification may be performed. Therefore, it is preferred to control the cooling rate to satisfy the above-described relations in order to secure uniform distribution of solidification nuclei in the cooling step and reduce structural differences, and thereby, a plated steel sheet having excellent surface quality may be obtained.

Meanwhile, although not particularly limited, according to an aspect of the present disclosure, after completing hot-dip plating by dipping the base steel sheet in a plating bath, an air knife treatment may be performed to satisfy the following Relation 2.

$$0.1\leq(AK\ \text{interval}\times\text{Thickness of steel sheet})/AK\ \text{Pressure}\leq 25 \quad \text{[Relation 2]}$$

where, in the relation 2, the AK interval represents an interval (mm) between knives, the thickness of the steel sheet represents a thickness (mm) after being treated with an air knife, and the AK pressure represents air knife pressure (kPa) of a nozzle.

Although not particularly limited, according to an aspect of the present disclosure, the interval of air knife may be in a range of 5 to 150 mm. In addition, a thickness of the steel sheet after being treated with the air knife may be in a range of 0.2 to 6 mm. In addition, the air knife pressure of the nozzle may be in a range of 8 to 70 kPa.

By controlling to satisfy the air knife condition and/or relation 2, described above, an air knife treatment is performed under severe conditions so that it is possible to prevent non-plating from occurring on the surface of the plated steel sheet. In addition, a uniform plating layer may be formed by contributing to uniform growth of a plurality of structures during solidification, and at the same time, an area ratio of the Al single phase included in the $MgZn_2$ phase to the total cross-sectional area of the plating layer and an area ratio of the Al single phase to the total cross-sectional area of the plating layer may be controlled within an appropriate range. Therefore, it is possible to effectively provide a plated steel sheet having excellent corrosion resistance and excellent surface quality.

In addition, according to an aspect of the present disclosure, although not particularly limited, during the cooling, cooling may be performed so that a ratio (De/Dc) of a damper opening rate (De) of an edge portion to a damper opening rate (Dc) to a central portion of the selectively hot-dip galvanized steel sheet in a width direction satisfy 60 to 99%. In this case, the 'width direction' of the steel sheet refers to a direction, perpendicular to a conveying direction of the steel sheet, based on a surface excluding a thickness-side surface of the hot-dip galvanized steel sheet (i.e., a surface where the thickness of the steel sheet is visible). In addition, the damper opening rate is a numerical value referring to an opening degree of a control plate for controlling a flow rate of cooling gas to be sent from a cooling device to the base steel sheet. In order to secure a uniform cooling capacity according to a width of the steel sheet, which will be described later, a damper is installed so that a total cooling gas input or controlled to the cooling device may be divided into the central portion and the edge portion according to the width direction of the base steel sheet and injected. A boundary between the dampers may be divided into three sections according to the width of the base steel plate, and a position thereof may variably controlled so that a middle section is occupied as a central portion, and two sections on an outer edge thereof are occupied as an edge portion.

During cooling the conventional hot-dip galvanized steel sheet, there was a problem in that it is difficult to secure microstructural characteristics on the surface of the plating layer by making the flow rate of the cooling gas constant in the edge portion and the center portion without using a method or device for adjusting the ratio (De/Dc). In contrast, in the present disclosure, contrary to usual cooling conditions, the damper opening rate of the edge portion may be controlled to be lower than that of the central portion by setting the ratio (De/Dc) to a range of 60 to 99%, so that uniform cooling performance may be realized in the width direction of the steel sheet. That is, the present inventors recognize that the edge portion has a larger area exposed to an external atmosphere than the central portion, in the width direction of the steel sheet, so that a temperature of the steel sheet in a region corresponding to the edge portion is inevitably lowered at a faster rate than the central portion, and have found that it is possible to secure uniform characteristics of the surface of the plating layer by artificially reducing the cooling rate at the edge portion. That is, cooling gas incident on the central portion in the aforementioned cooling process naturally escapes from the central portion to an external portion through the edge portion. However, since the edge portion receives the cooling gas incident on the edge portion and the cooling gas after being incident on the central portion part in an overlapping manner, the cooling gas may be overcooled compared to the center portion and adversely affect the cooling gas. Therefore, since the cooling rate of the edge portion is faster even without applying artificial cooling gas, uniform cooling performance in the width direction is realized, and at the same time, LDH (Layered Double Hydroxide; $(Zn,Mg)_6Al_2(OH)_{16}(CO_3)\cdot 4H_2O$)) is formed as an initial corrosion product, so that, in order to increase corrosion resistance, the damper opening rate of the edge portion needs to be controlled to be lower than that of the central portion.

In this case, when the ratio (De/Dc) of the damper opening rate (De) of the edge portion to the damper opening rate (Dc) of the central portion is less than 60%, the edge portion is cooled more slowly than the central portion, and when exceeding 99%, the edge portion is overcooled compared to the central portion, which may be disadvantageous in implementing uniform cooling performance in the width direction of the steel sheet. Due thereto, a structure of the surface of the plating layer in the edge portion and the central portion becomes non-uniform, and when maintained under a corrosive environment or under an atmospheric environment for a long period of time, LDH (Layered Double Hydroxide; $(Zn,Mg)_6Al_2(OH)_{16}(CO_3)\cdot 4H_2O$)) as an initial corrosion product may be difficult to be formed uniformly.

In addition, although not particularly limited, according to an aspect of the present disclosure, an operation of removing surface oxides of the base steel sheet before plating may be further included. In this case, a shot blasting treatment before plating may be performed to remove the surface oxides of the base steel sheet. In addition, there is an effect of activating a plating reaction by giving fine plastic deformation to a surface of the steel sheet to increase the dislocation density in a structure of base iron.

In addition, according to an aspect of the present disclosure, a diameter of a metal ball used in the shot blasting treatment may be 0.3 to 10 μm.

According to an aspect of the present disclosure, the operating speed of the steel sheet may be controlled to 50 to 150 mpm (meters per minute) during the shot blasting treatment.

According to an aspect of the present disclosure, it is possible to control the metal ball to collide with a surface of the steel sheet at a projection amount of 300 to 3,000 kg/min during the shot blasting treatment.

According to an aspect of the present disclosure, by using a metal ball having a diameter of 0.3 to 10 μm, a metal ball of 300 to 3,000 kg/min collides with the surface of the steel plate on a steel sheet moving at a moving speed of 50 to 150 mpm, and a shot blasting treatment may be performed.

According to an aspect of the present disclosure, by performing a shot blasting treatment before plating the base steel sheet to satisfy the above-described conditions for the base steel sheet before plating, in order that a inhibition layer may be formed rapidly and uniformly by introducing mechanical potential before surface plating, or solidification nuclei may be formed more uniformly during solidification of the plating layer, a surface of the base steel sheet may be activated.

That is, by satisfying the above-described conditions during a shot blasting treatment, a problem in which the structure is formed rough due to the severe shot blasting treatment, resulting in deterioration of workability, or a problem in which a degree of activation of the surface of the base steel sheet before plating is low due to the insufficient shot blasting treatment, resulting in uniformity of the surface, may be prevented.

Therefore, it is possible to easily manufacture a plated steel sheet satisfying one or more of Ra, Rz, cross-sectional hardness and thickness of the plating layer in the specific range described above by performing a shot blasting treatment on the base steel sheet before plating, and optimizing the treatment conditions of the shot blasting, and accordingly, a plated steel sheet having excellent corrosion resistance and workability, as well as uniformity or surface quality suppressing the occurrence of non-plated regions.

Mode for Invention

EXAMPLE

Hereinafter, the present disclosure will be described in more detail with reference to Examples. However, the following Examples are provided to illustrate and describe the present disclosure in detail, but are not intended to limit the scope of the present disclosure. This is because the scope of the present disclosure is determined by contents disclosed in the claims and contents reasonably inferred therefrom.

Experimental Example 1

For a base steel sheet having a composition of 0.025% of C, 0.03% of Si, 0.15% of Mn, 0.01% of P, 0.003% of S, 0.03% of Al 0.03%, with a balance of Fe and other unavoidable impurities, the base steel sheet was immersed in a plating bath satisfying the conditions of Table 1 below, to obtain a hot-dip plated steel sheet. The hot-dip plated steel sheet was cooled using an inert gas in a portion of a cooling section from a zinc surface of the plating bath to a top roll section thereof, to satisfy cooling rates described in Table 1 below.

TABLE 1

| | Plating bath composition (wt %) | | | | | | plating bath temperature | | | | | Average cooling rate to Top roll | Type of |
|---|---|---|---|---|---|---|---|---|---|---|---|---|---|
| No. | Mg | Al | Si | Sn | Zn | Ts* | [° C.] | t* | A* | B* | C* | [° C. / s] | gas |
| A1 | 4.1 | 8.9 | 0.005 | 0.003 | 87.0 | 390 | 450 | 4.5 | 4 | 3 | 3 | 3 | $N_2$ |
| A2 | 4.3 | 11.3 | 0.001 | 0.005 | 84.4 | 415 | 470 | 2.5 | 13 | 10 | 9 | 13 | $N_2$ |
| A3 | 5.1 | 11.3 | 0.004 | 0.02 | 83.6 | 419 | 490 | 0.4 | 40 | 23 | 21 | 27 | $N_2$ |
| B1 | 5.4 | 12.9 | 0.007 | 0.001 | 81.7 | 430 | 490 | 3.5 | 10 | 8 | 10 | 9 | $N_2$ |
| B2 | 5.9 | 13.5 | 0.1 | 0.09 | 80.4 | 441 | 480 | 0.6 | 35 | 22 | 19 | 27 | $N_2$ + Ar |
| B3 | 6.4 | 13.8 | 0.15 | 0.07 | 79.6 | 452 | 500 | 1.6 | 29 | 18 | 15 | 20 | Ar |
| C | 4.0 | 8.0 | 0.25 | 0.05 | 87.7 | 391 | 450 | 5.5 | 2 | 3 | 3 | 2.5 | — |
| D | 6.6 | 15.0 | 0.3 | 0.09 | 78.0 | 441 | 500 | 1.5 | 11 | 15 | 21 | 15 | $N_2$ |
| E | 5.2 | 11.5 | 0.1 | 0.3 | 82.9 | 430 | 490 | 0.7 | 25 | 27 | 21 | 25 | $N_2$ |
| F | 6.0 | 13.5 | 0.25 | 0.05 | 80.2 | 464 | 545 | 0.4 | 31 | 30 | 25 | 35 | $N_2$ |
| G | 4.0 | 8.0 | 0.2 | 0.03 | 87.8 | 391 | 475 | 1.6 | 24 | 17 | 15 | 18 | $N_2$ |
| H | 5.0 | 15.0 | 0.15 | 0.06 | 79.8 | 436 | 470 | 1.5 | 21 | 15 | 13 | 17 | $N_2$ |
| I | 5.5 | 12.6 | 0.18 | 0.09 | 81.6 | 431 | 515 | 2.5 | 11 | 8 | 8 | 9 | $N_2$ |
| J | 6.2 | 13.8 | 0.15 | 0.05 | 79.8 | 446 | 500 | 6.5 | 3 | 3.5 | 3.5 | 3.3 | $N_2$ |

Ts*: a solidification start temperature in an equilibrium phase diagram t*: a thickness of a steel sheet [mm]

A*: an average cooling rate from a plating bath temperature to a plating solidification start temperature [° C./s]

B*: an average cooling rate from a plating solidification start temperature to a plating solidification start temperature −30° C. [° C./s]

C*: an average cooling rate from a plating solidification start temperature −30° C. to 300° C. [° C./s]

Meanwhile, a composition of the plating layer was measured by dissolving the plating layer in a hydrochloric acid solution for the above-described plated steel sheet and analyzing the dissolved liquid by a wet analysis (ICP) method. In addition, a cross-sectional specimen cut in a direction, perpendicular to a rolling direction of the steel sheet was prepared so that an interface between the plating layer and base iron was observed. After preparing a cross-sectional specimen, it was imaged by SEM, it was confirmed that a base steel sheet; a Zn—Mg—Al-based plating layer; and a Fe—Al-based inhibition layer was formed between the base steel sheet and the Zn—Mg—Al-based plating layer. Referring to FIG. 4, which is an image captured by FE-SEM by magnifying a cross-sectional specimen of such a plated steel sheet in a thickness direction at a magnification of 1,000, as an example, an occupied length of an outburst phase was measured by applying the above-described measurement method of FIG. 8 as it is. In addition, the number of $Mg_2Si$ alloy phases having a major axis of 500 nm or more formed at the interface between the inhibition layer and the plating layer per 100 μm of an interface length was measured. In addition, the characteristics were evaluated based on the following criteria for each example.

<Corrosion Resistance>

In order to evaluate corrosion resistance, a salt spray tester (Salt Spray Tester) was used to evaluate the corrosion resistance according to a test method conforming to ISO 4993 according to the following criteria.

◎: a time taken for red rust to occur was exceeded 30 times that of Zn plating of the same thickness ○: a time taken for red rust to occur was 20 times or more and less than 30 times compared to Zn plating of the same thickness Δ: a time taken for red rust to occur was 10 times or more and less than 20 times compared to Zn plating of the same thickness X: a time taken for red rust to occur was less than 10 times that of Zn plating of the same thickness <Uniformity>

In order to evaluate uniformity, a cross-section of the plating layer was photographed in a Back Scattering Mode (BSI) using an SEM device, to identify a phase in the plating layer. After taking 5 random spots with a length of 600 μm, a length of a section in which $MgZn_2$ crystals with a circle-equivalent diameter of 5 μm or more were not formed were measured and evaluated according to the following criteria.

◎: a length of the section where $MgZn_2$ crystals with a circle-equivalent diameter of 5 μm or more are not formed is less than 100 μm ○: a length of the section where $MgZn_2$ crystals with a circle-equivalent diameter of 5 μm or more are not formed is 100 μm or more and less than 200 μm Δ: a length of the section where $MgZn_2$ crystals with a circle-equivalent diameter of 5 μm or more are not formed is 200 μm or more and less than 300 μm X: a length of the section where $MgZn_2$ crystals with a circle-equivalent diameter of 5 μm or more are not formed is 300 μm or more <Bendability>

In order to evaluate bendability, after 3T bending using a bending test device, the bendability was evaluated using a method obtaining an average of crack widths of the plating layer of the bent portion according to the following criteria.

◎: an average width of cracks in the plating layer after 3T bending is less than 30 μm ○: an average width of cracks in the plating layer after 3T bending is 30 μm or more and less than 50 μm Δ: an average width of cracks in the plating layer after 3T bending is 50 μm or more and less than 100 μm X: an average width of cracks in the plating layer after 3T bending is 100 μm or more The evaluation results for the above-described measured values and characteristics were illustrated in Table 2 below.

TABLE 2

| | | Plating layer composition (wt %) | | | | | | | | Evaluation of properties | | |
|---|---|---|---|---|---|---|---|---|---|---|---|---|
| | No. | Mg | Al | Si | Sn | Fe | Zn | Na* | Lo* | corrosion resistance | Uniformity | Bendability |
| Example 1 | A1 | 4.0 | 8.9 | 0.005 | 0.004 | 0.2 | 87.6 | 0 | 0 | ◎ | ○ | ○ |
| Example 2 | A2 | 4.5 | 11.4 | 0.004 | 0.005 | 0.3 | 84.0 | 0 | 0 | ◎ | ○ | ○ |
| Example 3 | A3 | 5.0 | 11.5 | 0.005 | 0.05 | 0.2 | 83.4 | 0 | 0 | ◎ | ○ | ○ |
| Example 4 | B1 | 5.5 | 13.0 | 0.007 | 0.001 | 0.3 | 81.5 | 1 | 0 | ◎ | ○ | ○ |
| Example 5 | B2 | 6.0 | 13.9 | 0.1 | 0.09 | 0.1 | 79.9 | 3 | 0 | ◎ | ○ | ○ |
| Example 6 | B3 | 6.5 | 14.0 | 0.15 | 0.07 | 0.1 | 79.3 | 4 | 0 | ◎ | ○ | ○ |
| Example 7 | C | 4.2 | 7.9 | 0.27 | 0.05 | 3.5 | 84.3 | 11 | 0 | Δ | Δ | Δ |
| Example 8 | D | 6.7 | 15.1 | 0.05 | 0.01 | 0.3 | 78.8 | 12 | 14 | ○ | Δ | ○ |
| Example 9 | E | 5.3 | 11.6 | 0.1 | 0.25 | 0.2 | 83.3 | 15 | 5 | ○ | X | Δ |
| Example 10 | F | 6.2 | 13.8 | 0.3 | 0.04 | 5.5 | 70.7 | 20 | 25 | Δ | Δ | X |
| Example 11 | G | 4.1 | 7.9 | 0.2 | 0.03 | 4.5 | 83.2 | 11 | 12 | Δ | ○ | X |
| Example 12 | H | 5.2 | 15.1 | 0.15 | 0.06 | 5.1 | 74.4 | 13 | 16 | Δ | Δ | X |
| Example 13 | I | 5.6 | 12.7 | 0.19 | 0.08 | 3.2 | 78.2 | 15 | 13 | Δ | ○ | X |
| Example 14 | J | 6.2 | 13.8 | 0.15 | 0.05 | 0.2 | 79.6 | 15 | 0 | Δ | Δ | Δ |

Lo*: When an interface line of the base steel sheet is spaced 5 μm apart toward a surface of the plating layer, a ratio of the length, occupied by an outburst phase intersecting the spaced line to a length of the spaced line (%)

Na*: the number of $Mg_2Si$ alloy phases with a major axis of 500 nm or more formed at an interface between the inhibition layer and the plating layer per 100 μm of a length of the interface.

As can be seen in Tables 1 and 2, in the case of Examples 1 to 6, satisfying both the composition and manufacturing conditions of the plating layer according to the present disclosure, it was confirmed that the properties of corrosion resistance, uniformity and bendability were all excellent, compared to Examples 7 to 14, not satisfying at least one of the composition and manufacturing conditions of the plating layer.

Meanwhile, for the plated steel sheet prepared in Example 1, a cross-sectional specimen cut in a direction, perpendicular to a rolling direction of the steel sheet was made so that an entire plating layer and base iron were observed together. A photograph of the cross-sectional specimen was taken by FE-SEM at a magnification of 500 was shown in FIG. 1. Thereby, it was confirmed that a Fe—Al-based inhibition layer and a Zn—Al—Mg-based plating layer were formed on the base steel sheet.

In addition, for the plated steel sheet prepared in Example 4, a photograph of a cross-sectional specimen cut in the same manner as described above was magnified with FE-SEM at a magnification of 500 and observed by FE-SEM, which was shown in FIG. 2.

In addition, a photograph obtained by observing a surface of the plated steel sheet prepared in Example 2 by FE-SEM at a magnification of 1,000 was shown in FIG. 3.

Experimental Example 2

A plated steel sheet was manufactured in the same manner as in Experimental Example 1 described above, except that conditions were added to satisfy an interval of an air knife (AK), a thickness of the steel sheet, and air knife pressure of Table 3 below. In this case, using the same analysis method as in Experimental Example 1, it was confirmed that a Zn—Al—Mg-based plating layer and a Fe—Al-based inhibition layer were formed on the base steel sheet.

TABLE 3

| | No. | Thickness of steel sheet [mm] | AK interval [mm] | AK pressure [KPa] | Relation 2 | Plating layer composition (wt %) Mg | Al | Si | Sn | Fe | Zn |
|---|---|---|---|---|---|---|---|---|---|---|---|
| EXAMPLE 15 | A1 | 0.4 | 10 | 50 | 0.08 | 4 | 8.5 | 0.005 | 0.004 | 0.2 | 87.3 |
| EXAMPLE 16 | A1 | 0.4 | 15 | 10 | 0.60 | 4.1 | 8.7 | 0.003 | 0.005 | 0.2 | 87.0 |
| EXAMPLE 17 | A2 | 1 | 50 | 14.8 | 3.39 | 4.6 | 11.7 | 0.001 | 0.004 | 0.1 | 83.6 |
| EXAMPLE 18 | A3 | 1.5 | 150 | 8 | 28.13 | 5 | 11.5 | 0.005 | 0.05 | 0.2 | 83.2 |
| EXAMPLE 19 | A3 | 1.5 | 20 | 8 | 3.75 | 4.8 | 11.7 | 0.004 | 0.05 | 0.2 | 83.2 |
| EXAMPLE 20 | B1 | 2.5 | 25 | 50 | 1.25 | 5.5 | 12.9 | 0.007 | 0.001 | 0.3 | 81.3 |
| EXAMPLE 21 | B3 | 6 | 100 | 25 | 24.00 | 6.3 | 13.8 | 0.15 | 0.07 | 0.1 | 79.6 |
| EXAMPLE 22 | E | 6 | 50 | 11 | 27.27 | 5.2 | 9 | 0.1 | 0.2 | 0.2 | 85.3 |

For the plated steel materials prepared from the examples in Table 3 above, an area ratio of an Al single phase contained in a $MgZn_2$ phase to a total cross-sectional area of the plating layer was measured. In this case, the Al single phase contained in the $MgZn_2$ phase was measured by the method described above in the present specification, as illustrated in FIG. 7, using a photograph taken of a cross-section of the plated steel sheet with a field emission scanning electron microscope (FE-SEM) and EPMA (Electron Probe Micro Analyzer), results of component mapping were analyzed using EPMA (Electron Probe Micro Analyzer) so that Mg and Al component distributions could be seen, and $MgZn_2$ and Al single phases were separately measured. In addition, as for a thickness of an inhibition layer, a minimum thickness thereof in a direction, perpendicular to an interface was measured using an SEM or TEM apparatus.

TABLE 4

| | Plating layer | | | | | | Inhibition layer | |
|---|---|---|---|---|---|---|---|---|
| | | | | Al single phase | | | | Fe content of |
| | | | | Area | Content (wt %) | | Thickness | outburst phase |
| | Lo* | Na* | Ne* | fraction | Al | Zn | [μm] | (wt %) |
| EXAMPLE 15 | 0 | 0 | 0.6 | 1 | 40 | 50.4 | 1 | — |
| EXAMPLE 16 | 0 | 0 | 1.0 | 1.7 | 54.5 | 38.5 | 1.2 | — |
| EXAMPLE 17 | 0 | 0 | 3.0 | 9.8 | 67.5 | 31.5 | 0.9 | — |
| EXAMPLE 18 | 0 | 0 | 4.8 | 15.0 | 71.5 | 28.5 | 0.05 | — |
| EXAMPLE 19 | 0 | 0 | 3.2 | 8.8 | 59.4 | 38.5 | 0.05 | — |
| EXAMPLE 20 | 0 | 0 | 0.5 | 0.8 | 51.5 | 47.9 | 0.1 | — |
| EXAMPLE 21 | 0 | 2 | 2.1 | 3.9 | 55.8 | 42.9 | 0.1 | — |
| EXAMPLE 22 | 5 | 11 | 0 | 0 | — | — | 0.1 | 21 |

Ne*: an area ratio of an Al single phase included inside $MgZn_2$ phase to a total cross-sectional area of the plating layer Meanwhile, with respect to the experimental examples in Table 4, it was observed whether or not there are the following examples as the Al single phase included inside the $MgZn_2$ phase per 5,000 $\mu m^2$ of the cross-sectional area of the plating layer, and ○ and X are shown in Table 5 below. In this case, the presence or absence of each phase included in the plating layer was evaluated using the above-described FE-SEM photograph and component mapping result by EPMA.

(1) an Al single phase included inside a $MgZn_2$ phase, and completely included by the $MgZn_2$ phase (2) an Al single phase partly included inside the $MgZn_2$ phase, and partly protruding out of the $MgZn_2$ phase (3) an Al single phase in which a mixed phase of Al and Zn is completely included inside the $MgZn_2$ phase, and completely included inside the mixed phase of Al and Zn (4) an Al single phase, completely included in the mixed phase Al and Zn, a portion of which being included inside the $MgZn_2$ phase and the other portion of protruding out of the $MgZn_2$ phase (5) an Al single phase partly included in the mixed phase Al and Zn, a portion of which being included inside the $MgZn_2$ phase and the other portion of which protruding out of the $MgZn_2$ phase, and completely included inside a $MgZn_2$ region (6) an Al single phase partly included in the mixed phase of Al and Zn, a portion of which is being included inside the $MgZn_2$ phase and the other portion of which protruding out of the $MgZn_2$ phase, wherein a portion of the Al single phase is included inside the $MgZn_2$ region and the other portion of the Al single phase protrudes of the $MgZn_2$ region

TABLE 5

| | $MgZn_2$ phase of plating layer | | | | | |
|---|---|---|---|---|---|---|
| | (1) | (2) | (3) | (4) | (5) | (6) |
| EXAMPLE 15 | X | ○ | X | ○ | ○ | X |
| EXAMPLE 16 | ○ | ○ | ○ | ○ | ○ | X |
| EXAMPLE 17 | ○ | ○ | ○ | ○ | ○ | ○ |
| EXAMPLE 18 | X | ○ | ○ | ○ | ○ | ○ |
| EXAMPLE 19 | ○ | ○ | ○ | ○ | ○ | ○ |
| EXAMPLE 20 | X | ○ | X | ○ | ○ | ○ |
| EXAMPLE 21 | ○ | ○ | ○ | ○ | ○ | ○ |
| EXAMPLE 22 | X | X | X | X | X | X |

In particular, with respect to Example 8, a X-ray diffraction (XRD) measurement result of the plating layer was shown in FIG. 5, and in this case, it was confirmed that a diffraction intensity ratio I(200)/I(111), which is a ratio of (200) plane X-ray diffraction intensity I (200) of the Al single phase and (111) plane X-ray diffraction intensity I (111) of the Al single phase, is less than 0.8.

Meanwhile, the characteristics of Examples 5 to 22 described above were evaluated and shown in Table 6 below. In this case, corrosion resistance, uniformity, and bendability were evaluated on in the same manner as in Experimental Example 1 described above, and whether or not non-plated regions occurred was evaluated based on the following criteria.

<Whether or not there is a Non-Plated Region>

◎: No non-plating

○: 1 to 3 non-plating

Δ: 4 or more non-plating

TABLE 6

| | Evaluation of properties | | | |
|---|---|---|---|---|
| | Corrosion resistance | Uniformity | Bendability | Whether or not non-plating region occurs |
| EXAMPLE 15 | ◎ | ○ | ◎ | ○ |
| EXAMPLE 16 | ◎ | ○ | ◎ | ◎ |
| EXAMPLE 17 | ◎ | ○ | ◎ | ◎ |
| EXAMPLE 18 | ◎ | ○ | ○ | ◎ |

TABLE 6-continued

| | Evaluation of properties | | | |
|---|---|---|---|---|
| | Corrosion resistance | Uniformity | Bendability | Whether or not non-plating region occurs |
| EXAMPLE 19 | ◎ | ○ | ◎ | ◎ |
| EXAMPLE 20 | ◎ | ○ | ○ | ◎ |
| EXAMPLE 21 | ◎ | ○ | ◎ | ◎ |
| EXAMPLE 22 | ○ | X | Δ | Δ |

As seen in Tables 3 to 6, in the case of Example 5 to 21, satisfying both the composition and manufacturing conditions of the plating layer of the present disclosure, compared to Example 22, not satisfying the conditions of the plating layer, characteristics such as uniformity, whether or not non-plating occurs, and bendability, were more excellent.

In particular, in the case of Examples 16, 17, 19, and 21 of the present disclosure, satisfying the condition of Equation 2, it was confirmed that one or more of characteristics such as uniformity, whether or not a non-plated region occurs, and bendability were further improved, compared to Examples 15, 18, and 20, not satisfying that Relation 2.

Experimental Example 3

A plated steel sheet was manufactured in the same manner as in Experimental Example 2, except that the same base steel sheet as in Experimental Example 1 was subjected to a shot blasting treatment satisfying the conditions shown in Table 7 to remove surface oxides and then plating was performed. In this case, it was confirmed that an Fe—Al-based inhibition layer and a Zn—Al—Mg-based plating layer were formed on the base steel sheet in the same manner as in Experimental Example 1.

TABLE 7

| | | Air knife condition | | | Shot blasting condition | | |
|---|---|---|---|---|---|---|---|
| | No. | AK interval [mm] | Thickness of steel sheet [mm] | AK pressure [KPa] | Diameter of metallic ball [μm] | Moving speed [mpm*] | Weight of metallic ball per min. [kg/min] |
| EXAMPLE 23 | A1 | 0.4 | 20 | 15.5 | 0.5 | 160 | 3500 |
| EXAMPLE 24 | A1 | 0.4 | 20 | 15.5 | 0.5 | 140 | 2000 |
| EXAMPLE 25 | A2 | 1 | 26 | 18.555 | 0.5 | 100 | 100 |
| EXAMPLE 26 | A2 | 1 | 26 | 18.555 | 0.5 | 100 | 1000 |
| EXAMPLE 27 | A3 | 1.2 | 32 | 17.555 | 0.5 | 90 | 200 |
| EXAMPLE 28 | A3 | 1.2 | 32 | 16.115 | 0.5 | 90 | 1000 |
| EXAMPLE 29 | B1 | 1.6 | 28 | 16.115 | 5 | 85 | 3500 |
| EXAMPLE 30 | B1 | 1.6 | 28 | 14.83 | 5 | 85 | 3000 |
| EXAMPLE 31 | B2 | 4 | 40 | 14.83 | 5 | 60 | 250 |
| EXAMPLE 32 | B2 | 4 | 40 | 14.82 | 5 | 60 | 350 |
| EXAMPLE 33 | B3 | 6 | 60 | 14.82 | 9 | 50 | 100 |
| EXAMPLE 34 | B3 | 6 | 60 | 15.125 | 9 | 50 | 500 |
| EXAMPLE 35 | E | 0.5 | 25 | 15.125 | 5 | 180 | 100 |
| EXAMPLE 36 | F | 4.5 | 25 | 13.975 | 5 | 40 | 3500 |

mpm*: meter per minute mpm*: meter per minute

The results are shown in Tables 8 and 9 using the same measurement method as in Experimental Examples 1 and 2 described above. Meanwhile, Ra in Table 9 was measured using a two-dimensional surface roughness measuring device, Rz was measured using a KS B 0161 measuring method, and a cutoff value was measured based on 2.5 μm when measuring roughness. In addition, based on a cross-section of the plating layer, the cross-sectional hardness of the plating layer was measured using a microhardness measuring device capable of measuring in the thickness of the plating layer.

TABLE 8

| | Plating layer composition (wt %) | | | | | | | |
|---|---|---|---|---|---|---|---|---|
| | Mg | Al | Si | Sn | Fe | Zn | Lo* | Na* |
| EXAMPLE 23 | 4.1 | 8.7 | 0.07 | 0.002 | 0.2 | 86.9 | 5 | 1 |
| EXAMPLE 24 | 4.1 | 8.8 | 0.1 | 0.005 | 0.1 | 86.9 | 0 | 0 |
| EXAMPLE 25 | 4.5 | 11.5 | 0.003 | 0.003 | 0.2 | 83.8 | 0 | 0 |
| EXAMPLE 26 | 4.3 | 11.4 | 0.005 | 0.002 | 0.2 | 84.1 | 0 | 0 |
| EXAMPLE 27 | 5.1 | 11.4 | 0.005 | 0.03 | 0.1 | 83.4 | 0 | 0 |
| EXAMPLE 28 | 5.2 | 11.3 | 0.006 | 0.02 | 0.2 | 83.3 | 0 | 0 |
| EXAMPLE 29 | 5.5 | 13.1 | 0.007 | 0.001 | 0.1 | 81.3 | 8 | 0 |
| EXAMPLE 30 | 5.4 | 12.9 | 0.006 | 0.001 | 0.2 | 81.5 | 0 | 0 |
| EXAMPLE 31 | 5.9 | 13.4 | 0.12 | 0.08 | 0.1 | 80.4 | 0 | 5 |
| EXAMPLE 32 | 6 | 13.6 | 0.1 | 0.09 | 0.1 | 80.1 | 0 | 0 |
| EXAMPLE 33 | 6.2 | 13.9 | 0.13 | 0.07 | 0.2 | 79.5 | 0 | 8 |
| EXAMPLE 34 | 6.4 | 13.7 | 0.15 | 0.08 | 0.2 | 79.5 | 0 | 0 |
| EXAMPLE 35 | 5.3 | 11.6 | 0.12 | 0.25 | 0.2 | 82.5 | 23 | 15 |
| EXAMPLE 36 | 6.1 | 13.6 | 0.3 | 0.05 | 0.3 | 79.7 | 32 | 20 |

For the plated steel sheets manufactured in Examples 23 to 36 described above, properties were evaluated in the same manner as in Experimental Example 2, which are shown in Table 10 below.

TABLE 9

| | Plating layer | | | | | | | | Inhibition layer | |
|---|---|---|---|---|---|---|---|---|---|---|
| | Al single phase | | | Area fraction of single phase in MgZn2 phase | Ra [μm] | Rz [μm] | Cross-sectional hardness [Hv] | Thickness [μm] | Thickness [μm] | Fe content of outburst phase (wt %) |
| | Area fraction | content (wt %) Al | content (wt %) Zn | | | | | | | |
| EXAMPLE 23 | 1 | 38.5 | 50.8 | 0 | 0.5 | 1 | 220 | 4 | 2.5 | 22 |
| EXAMPLE 24 | 5 | 51.5 | 47.8 | 1 | 0.6 | 5 | 210 | 5 | 1.8 | — |
| EXAMPLE 25 | 11 | 55.5 | 44 | 2.5 | 0.7 | 6 | 190 | 6 | 0.8 | — |
| EXAMPLE 26 | 8 | 59.3 | 40.1 | 3 | 1.3 | 12 | 250 | 7 | 0.9 | — |
| EXAMPLE 27 | 9 | 61 | 38.4 | 2 | 2.9 | 25 | 400 | 30 | 0.05 | — |
| EXAMPLE 28 | 8 | 61.5 | 38.1 | 2.6 | 1.7 | 15 | 310 | 20 | 0.1 | — |
| EXAMPLE 29 | 12 | 59.4 | 40.3 | 0 | 1.5 | 15 | 460 | 60 | 0.05 | 21 |
| EXAMPLE 30 | 9 | 67.3 | 32.5 | 1.5 | 3.0 | 18 | 440 | 45 | 0.05 | — |
| EXAMPLE 31 | 1 | 43.5 | 45.6 | 0 | 0.5 | 4 | 470 | 105 | 0.05 | — |
| EXAMPLE 32 | 6 | 48.7 | 40.6 | 2 | 0.8 | 5 | 400 | 70 | 0.05 | — |
| EXAMPLE 33 | 5 | 38.5 | 50.9 | 0 | 0.5 | 0.5 | 460 | 110 | 0.1 | — |
| EXAMPLE 34 | 4 | 44.5 | 45.1 | 1.5 | 0.9 | 8 | 390 | 90 | 0.1 | — |
| EXAMPLE 35 | 0 | — | — | — | 0.4 | 0.5 | 190 | 4 | 0.1 | 23 |
| EXAMPLE 36 | 0 | — | — | — | 3.5 | 25 | 460 | 110 | 0.1 | 25 |

TABLE 10

| | | Evaluation of properties | | |
|---|---|---|---|---|
| | Corrosion resistance | Uniformity | Whether or not non-plating region occurs | Bendability |
| EXAMPLE 23 | ◎ | ◎ | ○ | ○ |
| EXAMPLE 24 | ◎ | ◎ | ◎ | ◎ |
| EXAMPLE 25 | ◎ | ◎ | ○ | ◎ |
| EXAMPLE 26 | ◎ | ◎ | ◎ | ◎ |
| EXAMPLE 27 | ◎ | ○ | ◎ | ◎ |
| EXAMPLE 28 | ◎ | ◎ | ◎ | ◎ |
| EXAMPLE 29 | ◎ | ○ | ◎ | ○ |
| EXAMPLE 30 | ◎ | ◎ | ◎ | ◎ |
| EXAMPLE 31 | ◎ | ○ | ◎ | ◎ |
| EXAMPLE 32 | ◎ | ◎ | ◎ | ◎ |
| EXAMPLE 33 | ◎ | ○ | ◎ | ◎ |
| EXAMPLE 34 | ◎ | ◎ | ◎ | ◎ |
| EXAMPLE 35 | ○ | Δ | X | X |
| EXAMPLE 36 | ○ | X | ○ | X |

As can be seen in Tables 8 to 10, in the case of Examples 23 to 34 of the present application, satisfying both the composition and manufacturing conditions of the plating layer of the present disclosure, compared to Examples 35 and 36, not satisfying the conditions of the plating layer, characteristics such as uniformity, whether or not non-plating occurs, bendability, and the like were further improved.

In particular, in the case of Examples 24, 26, 28, 30, 32, and 34, satisfying all shot blasting treatment conditions in which a metallic ball at 300 to 3,000 kg/min collides with a surface of the steel sheet moving at a moving speed of 50 to 150 mpm, the metallic ball used having a diameter of 0.3 to 10 μm it was confirmed that at least one of uniformity, whether or not non-plated regions occur, and bendability was further improved, compared to Examples 23, 25, 27, 29, 31 and 33, not satisfying at least one of the above-described shot blasting treatment conditions.

Experimental Example 4

Except for changing the manufacturing conditions to satisfy Table 11 below, and setting an average damper opening rate of the edge portion and the central portion in the width direction of the steel sheet based on the surface of the hot-dipped steel sheet during cooling as shown in Table 12 below, an experiment was conducted under the same conditions as in Example 1.

TABLE 11

| | | Plating bath composition (balance of Zn) [wt %] | | | | | Plating bath Temperature | | | | | |
|---|---|---|---|---|---|---|---|---|---|---|---|---|
| Remarks | No. | Mg | Al | Si | Sn | Ts* | [° C.] | t* | A* | B* | C* | Vc* |
| EXAMPLE 37 | K | 5.0 | 11.9 | 0.004 | 0.001 | 417 | 470 | 1.2 | 21 | 14 | 20 | 17 |
| EXAMPLE 38 | L | 5.3 | 12.3 | 0.005 | 0.004 | 425 | 480 | 2.5 | 16 | 9 | 13 | 13 |
| EXAMFLE 39 | M | 5.4 | 12.6 | 0.01 | 0.02 | 428 | 460 | 3.0 | 10 | 7 | 10 | 9 |
| EXAMFLE 40 | N | 3.5 | 10 | 0.02 | 0.03 | 408 | 450 | 6.0 | 29 | 17 | 10 | 9 |

TABLE 12

| Remarks | No. | De* | Dc* | De/Dc |
|---|---|---|---|---|
| EXAMPLE 37 | K | 62 | 99 | 63 |
| EXAMPLE 38 | L | 66 | 100 | 66 |
| EXAMPLE 39 | M | 60 | 98 | 61 |
| EXAMPLE 40 | N | 98 | 99 | 101 |

De*: an average damper opening rate of edge portion [%]

Dc*: an average damper opening rate in central portion [%]

A specimen of the plated steel sheet described above was prepared, the plating layer was dissolved in a hydrochloric acid solution, and the dissolved solution was analyzed by wet analysis (ICP) to measure a composition of the plating layer, so that it was confirmed that the composition of the plating layer of the present disclosure was satisfied. In addition, after preparing a cross-sectional specimen cut in a direction, perpendicular to a rolling direction of the steel sheet so that the interface between the plating layer and base iron is observed, photographed by SEM, it was confirmed that a base steel sheet; a Zn—Mg—Al-based plating layer; and an Fe—Al-based inhibition layer were formed between the base steel sheet and the Zn—Mg—Al-based plating layer.

For the surface specimens of the plating layer obtained from each Example and Comparative Example, characteristics were evaluated based on the following criteria, and the evaluation results of the characteristics are shown in Table 13 below.

<Plate Corrosion Resistance>

In order to evaluate corrosion resistance of a plate, a salt spray tester (SST) was used to perform evaluation according to the following criteria, by the testing method in accordance with ISO14993.

◎: a time taken for red rust to occur exceeded 40 times that of Zn plating of the same thickness ○: a time taken for red rust to occur was 30 times or more and less than 40 times compared to Zn plating of the same thickness Δ: a time taken for red rust to occur was more than 20 times and less than 30 times compared to Zn plating of the same thickness X: a time taken for red rust to occur was less than 20 times that of Zn plating of the same thickness <Bent Portion Corrosion Resistance>

In order to evaluate corrosion resistance of a bent portion, it was evaluated by a test method conforming to ISO14993 using a salt spray tester (SST). The corrosion resistance evaluation specimen was subjected to 90° bending with the same material thickness and the same plating amount.

◎: a time taken for red rust to occur was 30 times longer than Zn plating of the same thickness ○: a time taken for red rust to occur was 20 times or more and less than 30 times compared to Zn plating of the same thickness Δ: a time taken for red rust to occur was 10 times or more and less than 20 times compared to Zn plating of the same thickness X: a time taken for red rust to occur was less than 10 times that of Zn plating of the same thickness <Scattering Reflectance>

Each specimen is collected by dividing a position thereof into ¼ point, center, ¾ point, and edge in a width direction of the hot-dip plated steel sheet. In order to evaluate an amount of scattered and reflected light compared to total reflection for each specimen, light in a visible light wavelength band (400 to 800 nm) was incident on an integrating sphere and evaluated by a test method conforming to ISO9001 according to the type of reflected light.

◎: a ratio of scattering reflectance to average total reflectance in a width direction exceeded 80%, and deviation of scattering reflectance in the width direction was less than 10%.

○: a ratio of scattering reflectance to average total reflectance in a width direction was 70% or more and less than 80%, and deviation of scattering reflectance in the width direction was 10% or more Δ: a ratio of scattering reflectance to average total reflectance in a width direction was 60% or more and less than 70%, and deviation of scattering reflectance in the width direction was 10% or more X: a ratio of scattering reflectance to average total reflectance in a width direction was less than 60%, and deviation of scattering reflectance in the width direction was 10% or more For the plated steel sheets obtained from Examples 37 to 40, the type of corrosion product initially formed on the surface and the time at which the LDH corrosion product was formed were measured using an EDS or XRD apparatus, and are shown in Table 13 below.

TABLE 13

| | | Time for | Evaluation of properties | | |
|---|---|---|---|---|---|
| Remarks | Types of corrosion products that first form on a surface | LDH corrosion products to be formed | Corrosion resistance plate portion | Corrosion resistance of bent portion | Scattering refectance |
| EXAMPLE 37 | Layered Double Hydroxide | 5 min. | ◎ | ◎ | ◎ |
| EXAMPLE 38 | Layered Double Hydroxide | 5 min. | ◎ | ◎ | ◎ |
| EXAMPLE 39 | Layered Double Hydroxide | 5 min. | ◎ | ◎ | ◎ |
| EXAMPLE 40 | Simonkolleite | — | Δ | X | X |

De*: an average damper opening rate of an edge portion [%]

262 Dc*: Average damper opening rate of an central portion [%]

As can be seen in Table 13, in the case of Examples 37 to 39 satisfying both the plating composition and the manufacturing conditions of the present disclosure, it was confirmed that LDH was first formed on a surface of the plated steel sheet during the corrosion resistance evaluation experiment. For this reason, it was confirmed that the corrosion resistance was further improved in a plate portion and a bent portion, and scattering reflectance of the surface of the steel sheet was somewhat high, so that the surface quality was excellent.

On the other hand, in the case of Example 40, not satisfying the cooling conditions of the present disclosure, it was confirmed that Simon colite was first formed on a surface of the plated steel sheet during the corrosion resistance evaluation experiment. For this reason, not only the plate corrosion resistance of the plated steel sheet, but also the corrosion resistance of the bent portion was somewhat inferior. In addition, it was confirmed that the scattering reflectance was also somewhat low and the surface quality was inferior.

While example embodiments have been shown and described above, it will be apparent to those skilled in the art that modifications and variations could be made without departing from the scope of the present disclosure as defined by the appended claims.

The invention claimed is:

1. A plated steel sheet, comprising:

a base steel sheet;

a Zn—Mg—Al based steel sheet plating layer provided on at least one surface of the base steel sheet; and an Fe—Al based inhibition layer provided between the base steel sheet and the Zn—Mg—Al based plating layer, wherein the plating layer comprises, by weight:

4% or more of Mg; 2.1 times or more of a Mg content and 14.2% or less of Al; 0.2% or less (including 0%) of Si; 0.1% or less (including 0%) of Sn, with a balance of Zn and unavoidable impurities, wherein, in a cut surface of the steel sheet in a thickness direction, when an interface line of the base steel sheet is spaced 5 μm apart toward a surface of the plating layer, a length occupied by an outburst phase intersecting the spaced line is 10% or less compared to a length of the spaced line, and, a Fe content of the outburst phase is 10 to 45% by weight, and an alloy phase of the outburst phase contains at least one of $Fe_2Al_5$, FeAl and Fe—Zn compounds, and contains 20% or more of Zn by weight, and wherein the outburst phase is an alloy phase including a Fe—Al based intermetallic compound other than the inhibition layer.

2. The plated steel sheet of claim 1, wherein a cross-sectional hardness of the plating layer is 200 to 450 Hv.

3. The plated steel sheet of claim 2, wherein a number of $Mg_2Si$ phases having a major axis of 500 nm or more, in contact with an interface between the plating layer and the inhibition layer is 10 or less per 100 μm.

4. The plated steel sheet of claim 1, wherein the Si content of the plating layer is 0.01% or less.

5. The plated steel sheet of claim 1, wherein the Sn content of the plating layer is 0.09% or less.

6. The plated steel sheet of claim 5, wherein the Sn content of the plating layer is 0.05% or less.

7. The plated steel sheet of claim 1, wherein a Fe content of the plating layer is 1% or less.

8. The plated steel sheet of claim 1, wherein the inhibition layer has a thickness of 0.02 μm or more and 2.5 μm or less.

9. The plated steel sheet of claim 1, wherein a sum of areas of an Al single phase included in a $MgZn_2$ phase exists in an area ratio of 0.5 to 10% to a total plating layer cross-sectional area.

10. The plated steel sheet of claim 9, wherein the single Al single phase is entirely or partly located inside the $MgZn_2$ phase.

11. The plated steel sheet of claim 10, wherein the Al single phase included inside the $MgZn_2$ phase is an Al single phase corresponding to at least one of the following cases:

an Al single phase included inside a $MgZn_2$ phase, and completely included by the $MgZn_2$ phase, an Al single phase, a portion of the Al single phase being included inside the $MgZn_2$ phase and the portion of Al single phase protruding out of the $MgZn_2$ phase, an Al single phase in which a mixed phase of Al and Zn is completely included inside the $MgZn_2$ phase, and completely included inside the mixed phase of Al and Zn, an Al single phase completely included inside the mixed phase Al and Zn, in which a portion of the Al single phase is included inside the $MgZn_2$ phase and the other portion of the Al single phase protrudes out of the $MgZn_2$ phase, an Al single phase partly included in the mixed phase of Al and Zn, in which a portion of the Al single phase is included inside the $MgZn_2$ phase and the other portion of the Al single phase protrudes out of the $MgZn_2$ phase, and completely included inside a $MgZn_2$ region, and Al single phase partly included in the mixed phase of Al and Zn, in which a portion of the Al single phase is included inside the $MgZn_2$ phase and the other portion of the Al single phase protrudes out of the $MgZn_2$ phase, wherein a portion thereof is included inside the $MgZn_2$ region and the other portion thereof protrudes out of the $MgZn_2$ region.

12. The plated steel sheet of claim 10, wherein the Al single phase comprises, by weight %, 40 to 70% of Al; 0.2%, with a balance of Zn and unavoidable impurities.

13. The plated steel sheet of claim 10, wherein, in the plating layer, a ratio of the Al single phase to the entire cross-section of the plating layer is 1 to 15% by area fraction.

14. The plated steel sheet of claim 1, wherein surface roughness Ra of the plating layer is 0.5 to 3.0 μm.

15. The plated steel sheet of claim 1, wherein surface roughness Rz of the plating layer is 1 to 20 μm.

16. The plated steel sheet of claim 1, wherein the thickness of the plating layer is 5 to 100 μm.

17. The plated steel sheet of claim 1, wherein a diffraction intensity ratio I(200)/I(111), which is a ratio of X-ray diffraction intensity I(200) of (200) plane of Al single phase in a $MgZn_2$ phase of the plating layer and X-ray diffraction intensity I(111) of (111) plane of Al single phase in a $MgZn_2$ phase of the plated layer, is 0.8 or less.

18. The plated steel sheet of claim 1, wherein, under an atmospheric environment and a chloride environment of ISO14993, $LDH((Zn,Mg)_6Al_2(OH)_{16}(CO_3)\cdot 4H_2O)$ is formed before simoncolite ($Zn_5(OH)_8Cl_2$) and hydrozinsite ($Zn_5(OH)_6(CO_3)_2$) on a surface of the Zn—Mg—Al-based plating layer.

19. The plated steel sheet of claim 1, wherein, under an atmospheric environment and a chloride environment of ISO14993, $LDH((Zn,Mg)_6Al_2(OH)_{16}(CO_3)\cdot 4H_2O)$ is formed on a surface of the Zn—Mg—Al-based plating layer within 6 hours in an atmospheric environment, and within 5 minutes in a chloride environment of ISO14993.

20. The plated steel sheet of claim 1, wherein a time taken for red rust to occur under a chloride environment including salt spray and dipping environments is 40 to 50 times longer than that of Zn—<g–Al plating of the same thickness in a flat sheet portion; and 20 to 30 times longer in 90 degree in a bending portion.

* * * * *